US005797202A

United States Patent [19]

Akesaka

[11] Patent Number: 5,797,202

[45] Date of Patent: Aug. 25, 1998

[54] VERTICAL HOLE EXCAVATING MACHINE

[75] Inventor: Toshio Akesaka, Kanagawa-ken, Japan

[73] Assignee: Kabushiki Kaisha Iseki Kaihatsu Koki, Japan

[21] Appl. No.: 750,334

[22] PCT Filed: Aug. 23, 1995

[86] PCT No.: PCT/JP95/01671

§ 371 Date: Dec. 5, 1996

§ 102(e) Date: Dec. 5, 1996

[87] PCT Pub. No.: WO96/06262

PCT Pub. Date: Feb. 29, 1996

[30] Foreign Application Priority Data

Aug. 25, 1994 [JP] Japan ..... 6-222679

[51] Int. Cl.[6] ..... E02F 3/24

[52] U.S. Cl. ..... 37/184; 37/91; 175/396; 299/60

[58] Field of Search ..... 37/189, 324, 326, 37/332, 365, 91, 386, 465, 466; 172/522, 59; 405/133, 233; 175/396, 108; 299/60, 56

[56] References Cited

U.S. PATENT DOCUMENTS

| | | | |
|---|---|---|---|
| 1,999,115 | 4/1935 | Shinn | 175/396 X |
| 2,756,037 | 7/1956 | Kirkpatrick | 299/60 |
| 2,798,707 | 7/1957 | Kandle | 299/60 |
| 2,864,600 | 12/1958 | Kirkpatrick | 299/60 |
| 2,873,950 | 2/1959 | Kandle | 175/396 X |
| 3,041,057 | 6/1962 | Pearson | 175/396 X |
| 3,413,033 | 11/1968 | Clark | 299/56 |
| 3,480,327 | 11/1969 | Matsushita | 299/60 |
| 3,779,322 | 12/1973 | Steven | 405/133 X |
| 5,078,545 | 1/1992 | Akesaka | 405/133 X |
| 5,470,132 | 11/1995 | Cartwright | 299/56 |

FOREIGN PATENT DOCUMENTS

| | | |
|---|---|---|
| 115750 | 5/1989 | Japan . |
| 4202995 | 7/1992 | Japan . |
| 443558 | 7/1992 | Japan . |

*Primary Examiner*—Tamara L. Graysay
*Assistant Examiner*—Thomas A. Beach
*Attorney, Agent, or Firm*—Webb Ziesenheim Bruening Logsdon Orkin & Hanson, P.C.

[57] ABSTRACT

A vertical hole excavating machine having a cutter head comprising: a first head supported rotatably about the axis of a cylindrical shield body at the lower end of the cylindrical body and having a central space vertically extending therethrough; at least one first cutter mounted on the first head to excavate earth under the first head; a second head disposed coaxially in the central space so as to be mounted or dismounted from above, and having a cylindrical portion for receiving matter excavated by the first cutter therein and a bottom plate for closing the lower end of the cylindrical portion; and at least one second cutter mounted on the second head to excavate earth under the second head. It is characterized in that the second head is further provided with a notch to receive matter excavated by the second cutter into the cylindrical portion.

15 Claims, 22 Drawing Sheets

VERTICAL HOLE EXCAVATING MACHINE

TECHNICAL FIELD

The present invention relates to an excavating machine for excavating a vertical hole.

BACKGROUND ART

There have been proposed various vertical hole excavating machines for excavating deep vertical holes, such as holes for the foundations of concrete structures, holes for the foundations of steel towers, holes for the foundations of bridge piers, shafts for tunnel excavation and shafts for mines. These known excavating machines, however, require the loading work for loading excavated matter into buckets or the like at the bottom of an excavated hole, and so the deeper the excavated hole becomes, the more difficult the disposal of the excavated matter becomes, and the longer time it takes for excavating the hole.

Accordingly, it is an object of the present invention to eliminate the loading work for loading excavated matter into buckets or the like at the bottom of an excavated hole.

DISCLOSURE OF THE INVENTION

A vertical hole excavating machine in accordance with the present invention comprises a cylindrical body disposed with its axis in a vertical position, a cutter head disposed to be rotatable about the axis at the lower end of the cylindrical body, and a driving mechanism for rotating the cutter head.

The cutter head includes a first head supported to be rotatable about the axis at the lower end of the cylindrical body and having a central space vertically extending therethrough; at least one first cutter disposed on the first head to excavate earth under the first head; a second head disposed in the central space and coaxially with the first head so as to be removably inserted from above, the second head having a cylindrical portion to receive matter excavated by the first cutter therein and a bottom closing the lower end of the cylindrical portion; and at least one second cutter disposed on the second head to excavate earth under the second head. The second head is provided in the bottom with an opening or notch to receive matter excavated by the second cutter into the cylindrical portion.

The cutter head is rotated about the axis of the cylindrical body by the driving mechanism to excavate a vertical hole of a diameter substantially equal to that of the cylindrical body with the first and the second cutters while the excavating machine is subjected to a downward force, such as the own deadweight and a force exerted thereto by a thrusting device or the like.

Matter excavated by the first cutter is moved toward the central space of the first head as the cutter head rotates and, finally, the matter is received into the cylindrical portion of the second head. Matter excavated by the second cutter is received through the notch of the second head into the cylindrical portion of the second head as the cutter head rotates.

When the cylindrical portion of the second head is filled up with the excavated matter, the second head is hoisted onto the surface of the ground by a hoisting machine, such as a crane, the excavated matter contained in the cylindrical portion is dumped on the ground, and then the second head is lowered to the bottom of the hole and mounted on the first head by the hoisting machine.

Thus, according to the present invention, the second head, i.e., one of the components of excavating means, is inserted from above detachably in the central space of the first head, i.e., another component of the excavating means, and excavated matter is received in the cylindrical portion of the second head. Accordingly, the loading work for loading excavated matter into buckets or the like at the bottom of the hole is unnecessary.

Preferably, the first head or the first cutter is provided with a guide for guiding matter excavated by the first cutter into the central space as the cutter head rotates so that the excavated matter can be surely loaded into the cylindrical portion of the second head.

Preferably, the second head is further provided with a lid disposed to be angularly rotatable about a horizontal axis on the upper side of the bottom so as to open and close the notch on the upper side of the bottom. The lid prevents the excavated matter contained in the second head from falling through the notch when the second head is moved between the bottom of the excavated hole and the surface of the ground.

Preferably, the first head is provided with a plurality of guide portions disposed on the upper surface of a member forming the upper end of the central space, each guide portion having an inclined guide surface such that the lower portion of the inclined guide surface is closer to the side of the central space than the upper portion. When the second head is inserted into the central space of the first head, the guide portions guide the second head toward the center of rotation even if the second head is displaced somewhat relative to the first head, so that the second head can be disposed in the central space of the first head simply by lowering the second head.

Preferably, the second head is further provided with a stopper on the outer periphery of the upper end of the cylindrical portion, the stopper coming into contact with the upper surface of the member defining the upper end of the central space to enable the vertical positioning of the second head simply by lowering the second head in the central space of the first head, which facilitates the work for mounting the second head on the first head.

Preferably, the vertical length of the second head is greater than that of the first head, and at least a part of the second head projects downward from the first head when the second head is disposed in the first head. Accordingly, the excavated matter containing capacity of the second head increases without increasing the diameter of the cylindrical portion of the second head.

Preferably, the second head is provided with an opening formed in its cylindrical portion so as to receive matter excavated by the first cutter into the cylindrical portion, and a shutter vertically movable along the inner circumference of the cylindrical portion to open and close the opening farmed therein. The opening is kept open to take matter excavated by the first cutter through the circumference of the cylindrical portion into the cylindrical portion of the second head during the excavating operation, and the opening is kept closed to prevent the excavated matter from falling through the opening while the second head is being lifted up or lowered.

Preferably, the first head has a plate-like portion forming a lower surface extending around the central space, the first cutter is disposed to excavate earth under the plate-like portion, and the plate-like portion is provided with an opening or notch to receive matter excavated by the first cutter into the upper surface, the notch communicating with an upper space on the the plate-like portion. Since matter excavated by the first cutter is received in the space extending over the plate-shaped part, a comparatively low excavation resistance acts on the first cutter and the excavated matter received in the space extending over the plate-like portion can be easily moved from the space toward the second head.

Preferably, the cutter head is further provided with a third cutter on the outer surface of the lower part of the cylindrical portion to excavate earth around the second head, and the second head is provided with an opening or notch in the lower part of the cylindrical portion to receive matter excavated by the third cutter into the cylindrical portion. Since earth around the cylindrical portion of the second head is excavated additionally, the cylindrical portion of the second head can be easily placed in and taken out from the hole formed by the second and the third cutters, which facilitates the work for placing the second head in the central space of the first head to discharge the excavated matter from the hole.

Preferably, the second head is provided outside the lower part of the cylindrical portion with a pair of pins extending in the opposite directions to each other. When transferring the excavated matter from the cylindrical portion to a predetermined place on the ground, the second head is suspended with the pins supported on the Y-shaped heads of stands or the like and the second head is tipped over on the pins to dump the excavated matter therefrom.

Preferably, a plurality of the first cutters are arranged at angular intervals around the axis of the cylindrical portion and the second head is provided with a plurality of openings formed at angular intervals around the axis of the cylindrical portion to receive matter excavated by the first cutters into the cylindrical portion, a plurality of shutters arranged to be movable vertically on the inner side surface of the cylindrical portion, each shutter opening and closing the opening, and a connecting member for connecting the upper end of both the shutters with each other. When the connecting member is raised, the shutters are raised relative to the cylindrical portion to close the openings due to the weight of the second head. The shutters are moved downward by their own weights to open the openings when the second head is placed at a predetermined place. Accordingly, the openings can be automatically opened and closed. Consequently, the second head can be mounted on and removed from the first head, and excavated matter can be taken into the second head simply by lowering and raising the second head.

Preferably, the vertical hole excavating machine further comprises a pushing mechanism for pushing the second head downward relative to the first head, the pushing mechanism being retractable to positions where the pushing mechanism does not interfere with the mounting and dismounting the second head in and from the central space. The upward movement of the second head relative to the first head during the excavating operation can be prevented to enable the second cutter to operate for excavation at a high efficiency.

An excavating machine in a preferred embodiment of the present invention further comprises a thrusting mechanism for thrusting down the cylindrical body, the thrusting mechanism including a plurality of jacks arranged at angular intervals around the axis of the cylindrical body so as to push the cylindrical body by react ion force from a lining disposed on the upper portion of the cylindrical body.

A vertical excavating machine in another preferred embodiment further comprises a thrusting mechanism for thrusting down the cylindrical body, the thrusting mechanism including a cylindrical m ember fitted on the upper portion of the cylindrical body so as to be axially movable relative to the cylindrical body, a plurality of arcuate pushing members successively arranged in the circumferential direction on the outer circumference of the cylindrical member, a plurality of first jacks for radially displacing the pushing members, and a plurality of second jacks arranged at angular intervals around the axis of the cylindrical body to push the cylindrical body by reaction force from the cylindrical member.

Each of the first jacks moves the pushing members adjacent to each other in the circumferential direction toward and away from each other. The cylindrical body and the cylindrical member are fitted on each other so as not to rotate relative to each other about the axis.

BEST MODE FOR CARRYING OUT THE INVENTION

Figure 1:
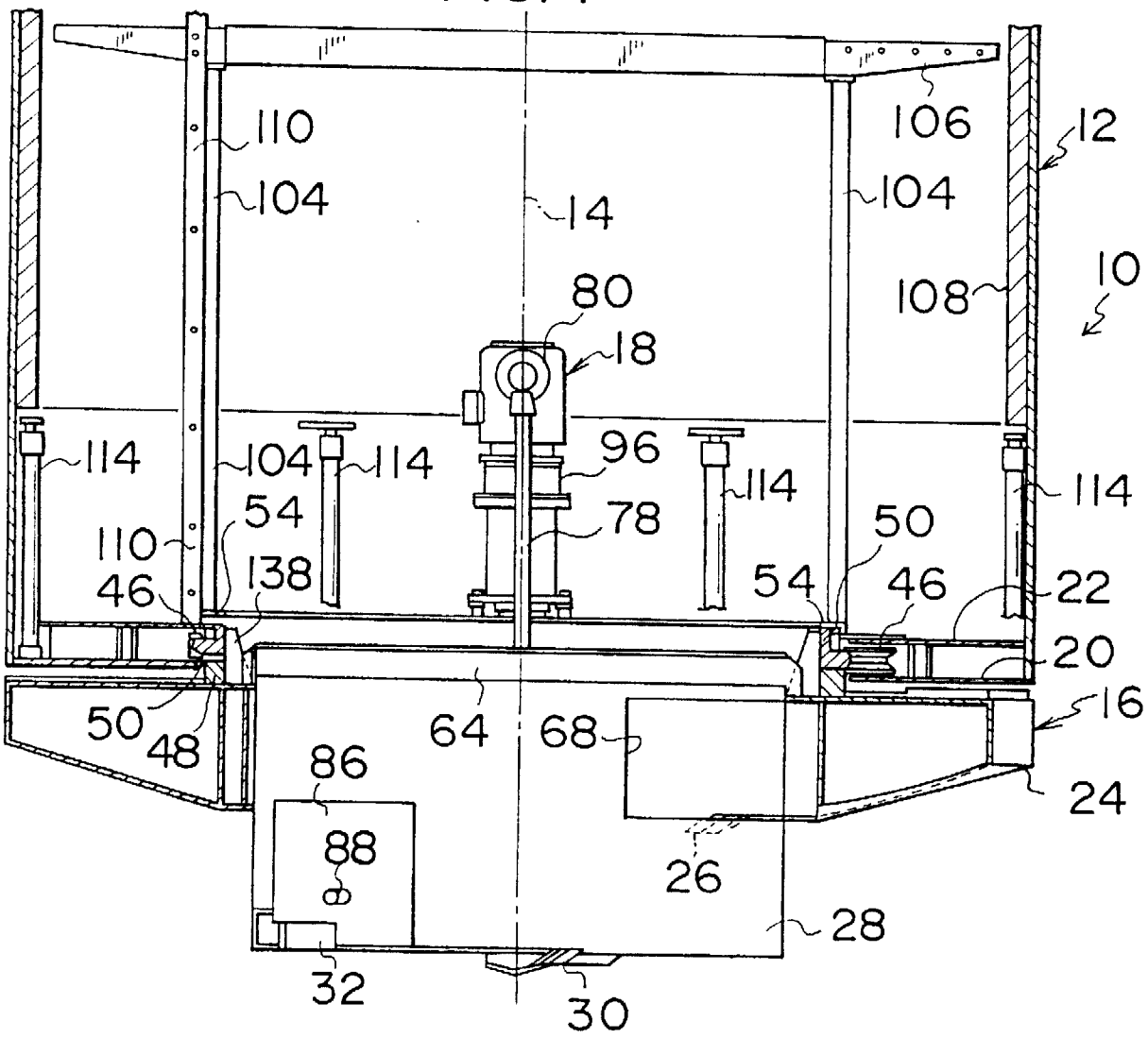
FIG. 1 is a longitudinal sectional view of a vertical hole excavating machine in a first embodiment according to the present invention.

Referring to FIG. 1, a vertical hole excavating machine 10 comprises a cylindrical shield body 12, a cutter head 16 disposed so as to rotate about the axis 14 of the cylindrical body 12 on the lower end of the cylindrical body 12, and driving mechanisms 18 for driving the cutter head 16 for rotation.

Figure 2:
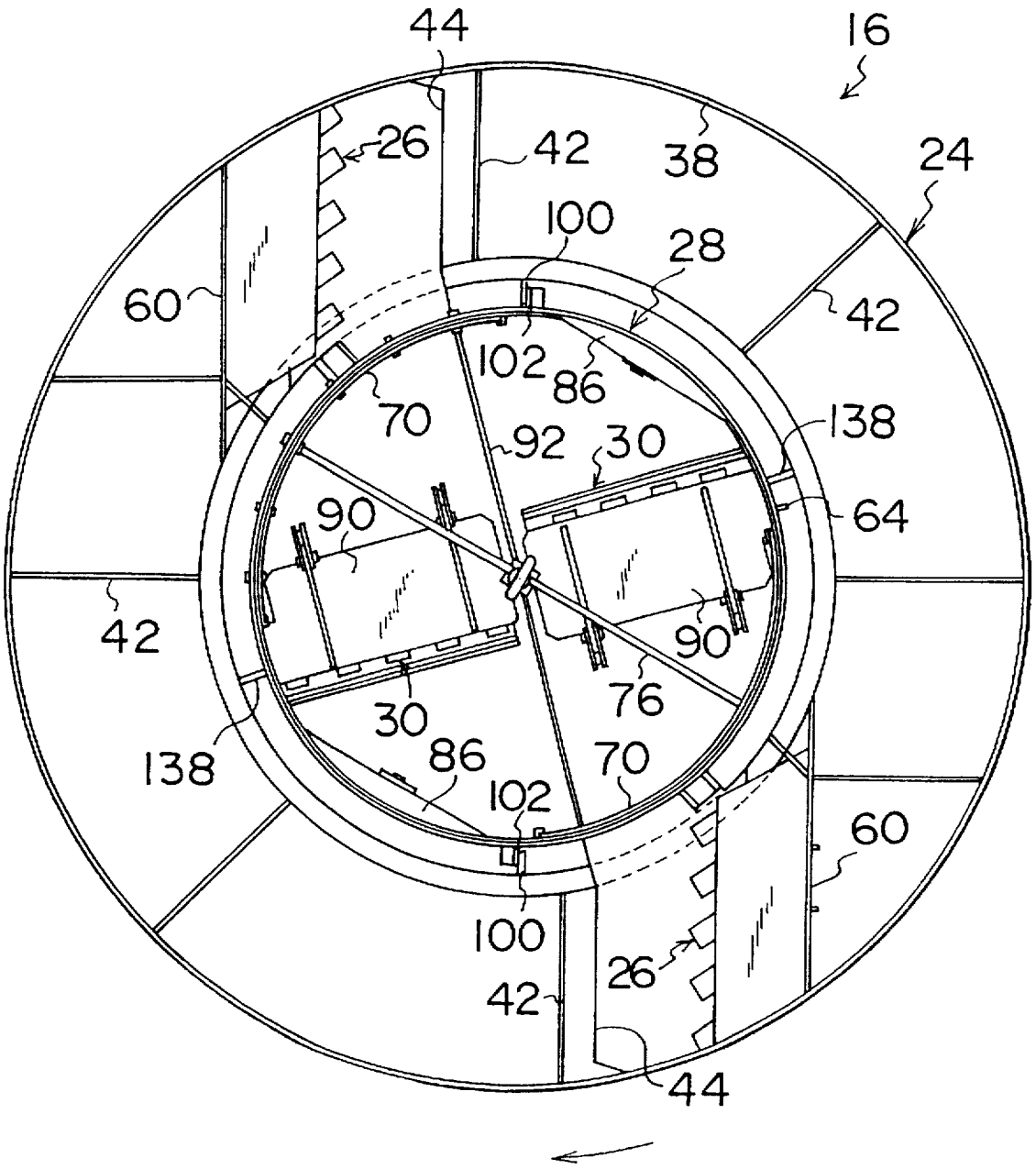
FIG. 2 is a plan view of a cutter head embodying the present invention, in which a ring, a cover and an upper plate are removed.
Figure 3:
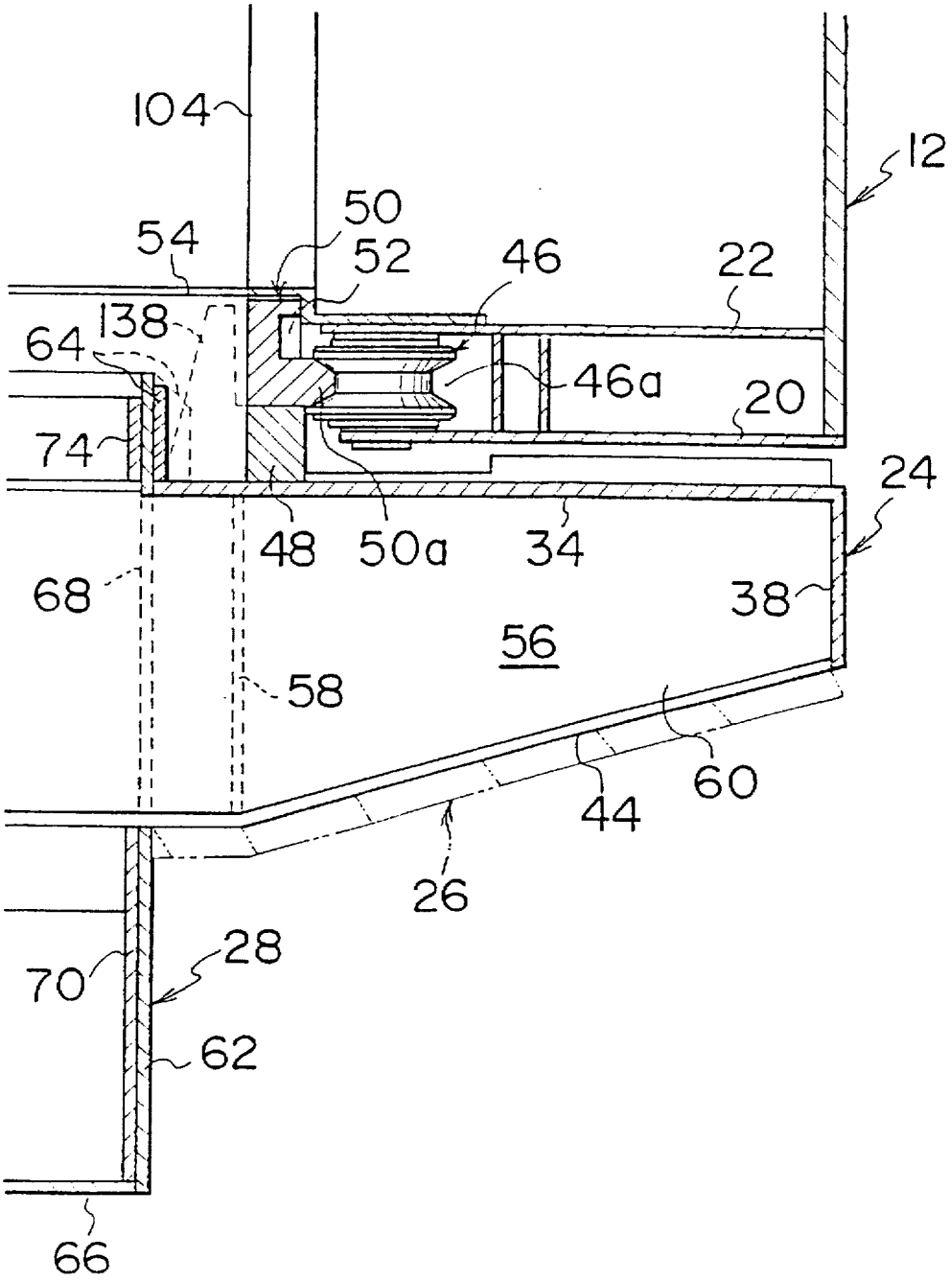
FIG. 3 is a partially enlarged longitudinal sectional view of a joint portion for connecting a body and a cutter head.
Figure 4:
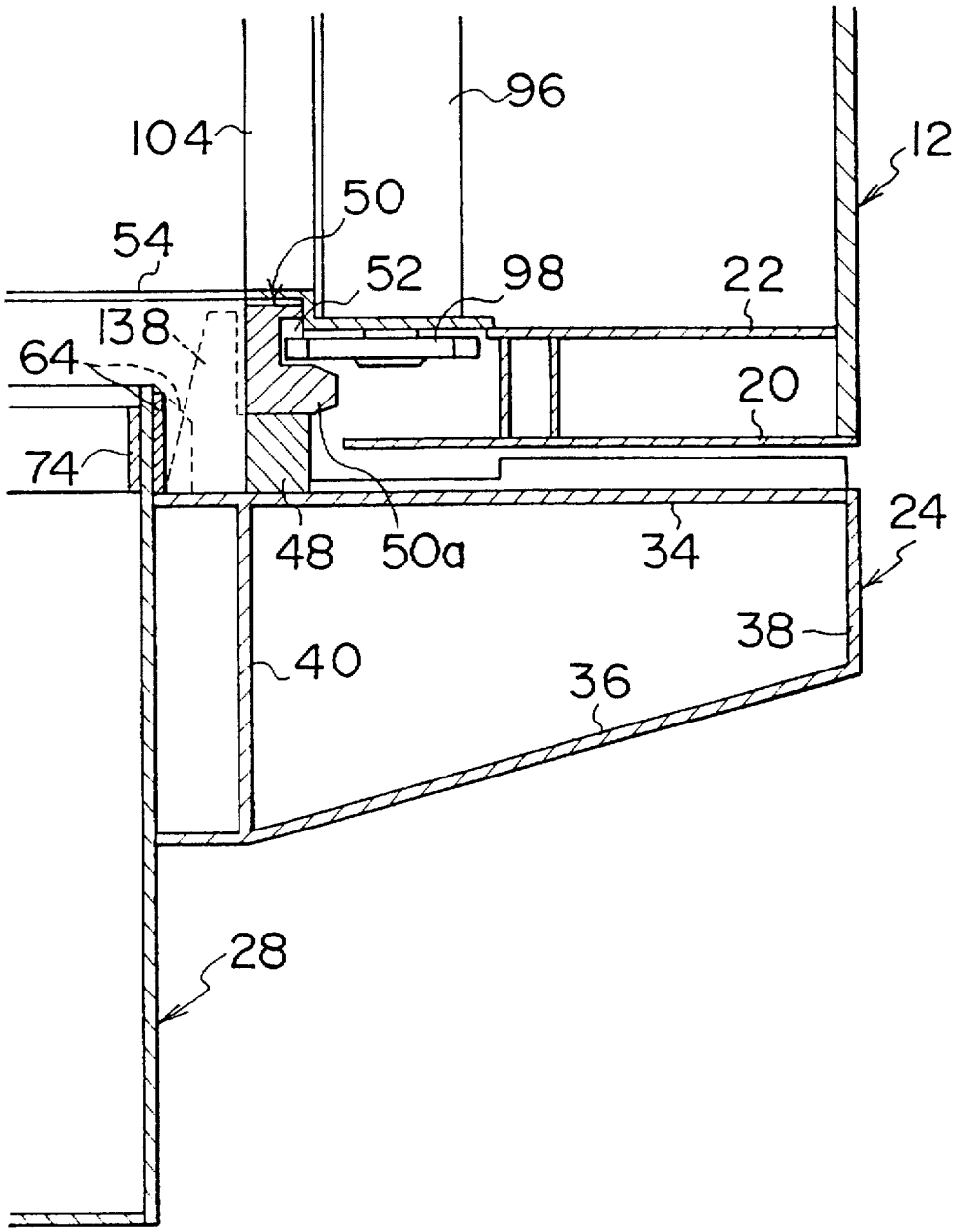
FIG. 4 is a partially enlarged longitudinal sectional view of another joint portion for connecting together the body and the cutter head.

As shown in FIGS. 1, 2 and 4, a ring-like bottom 20 is fastened to the lower end of the cylindrical body 12 coaxially with the cylindrical body 12 with bolts and nuts or the like in the shape of an inward flange. An annular bed 22 is formed on the bottom ring 20.

Although not shown in the drawings, the cylindrical body 12, the bottom ring 20 and the annular bed 22 are divided into a plurality of segments, preferably three or more segments, around the axis 14, and the circumferentially adjacent segments are separably joined together with bolts and nuts or the like to facilitate the transportation of the cylindrical body 12, the bottom ring 20 and the annular bed 22 and to enable the cylindrical body 12, the bottom ring 20 and the annular bed 22 to be disassembled for removal from the site.

Although not shown in the drawings, the divided portions of the cylindrical body 12 are separably connected to the two divided portions of the bottom ring 20 and the annular bed 22 with bolts and nuts or the like and, similarly, the divided portions of the bottom ring 20 and the annular bed 22 are separably connected to the two divided portions of the cylindrical body 12 with bolts and nuts or the like to enhance the joining strength of the circumferentially adjacent segments.

As shown in FIGS. 1 to 7, the cutter head 16 comprises an annular first head 24 supported so as to rotate about the axis 14 on the lower end of the cylindrical body 12, a plurality of first cutters 26 for excavating earth under the annular first head 24, a bucket-shaped second head 28 disposed coaxially with the first head 24 so as to be inserted from above into and to be removed from a central space vertically extending in the central portion of the first head 24, a plurality of second cutters 30 for excavating earth under the second head 28, and a plurality of third cutters 32 for excavating earth around the lower end of the second head 28.

As shown in FIGS. 1 to 4, the first head 24 has an upper plate 34, a lower plate 36, an outer side plate 38 and an inner side plate 40. Die upper plate 34, the lower plate 36, the outer side plate 38 and the inner side plate 40 are fastened together by welding or the like so as to form an annular space extending around the axis 14. The upper plate 34, the lower plate 36, the outer side plate 38 and the inner side plate 40 may be separably joined together with bolts and nuts or the like.

Although not shown in the drawings, the first head 24 is divided into a plurality of circumferentially divided segments around the axis 14 of the shield body 12, and the adjacent circumferential segments are separably joined together with bolts and nuts or the like. Therefore, the first head 24 can be easily transported, the first head 24 can be disassembled for removal from the site, and each of the upper plate 34, the lower plate 36, the outer side plate 38 and the inner side plate 40 comprises a plurality of segments corresponding to divided segments of the first head 24. The annular space of the first head 24 is partitioned into a plurality of chambers by a plurality of partition plates 42.

The lower plate 36 is tapered downward to form the lower surface of the first head 24 in the shape of a truncated circular cone. A plurality of openings or notches 44 (two diametrically opposite notches in this embodiment) are formed at angular intervals around the axis 14 of the cylindrical body 12. Upper edge portions of the partition plates 42 project upward from the upper plate 34 to form a plurality of radial ribs on the upper surface of the upper plate 34.

As shown in FIGS. 1, 3, 4 and 9, the first head 24 is supported so as to rotate on the lower end of t he cylindrical body 12 by a plurality of rollers 46 supported so as to rotate about axes parallel to the axis 14 of the cylindrical body 12 by shafts and brackets on the lower end of the cylindrical body 12, respectively, a seat ring 48 attached to the upper plate 34 with its axis aligned with the axis 14, and a support ring 50 attached to the seat ring 48 with bolts or the like.

The rollers 46 are arranged at equal angular intervals on an imaginary circle having an axis aligned with the axis 14 of the cylindrical body 12, and each roller 46 is provided with an annular groove **46*a* of a V-shaped cross section in its outer circumference. The number of the rollers 46 is three or more. The seat ring 48 and the support ring 50 extend coaxially with the cylindrical body 12 and the respective axes of the bearing ring 40, and the support ring 50 are aligned with the axis 14. The support ring 50 has an annular support ridge 50*a* slidably fitted in the annular grooves 46*a* of the rollers 46, and a gear 52 formed above the annular support ridge 50*a***.

The rollers 46, the seat ring 48 and the support ring 50 are protected by an annular cover 54. The annular cover 54 is attached detachably to the inner periphery of the annular bed 22 with a plurality of bolts or the like. The cover 54 may comprise a plurality of circumferentially divided segments, with the adjacent circumferential segments separably joined together with bolts and nuts or the like.

Each first cutter 26 comprises an elongate base member detachably attached to the lower surface of the lower plate 36 with a plurality of bolts or the like, and a plurality of cutting bits arranged at intervals on one of the edges of direction of the width on the base member. Each first cutter 26 is disposed on the lower plate 36 at a position corresponding to the notch 44 of the lower plate 36 with the cutting bits projected forward into part of the notch 44 from the rear edge of the notch 44 with respect to the direction of rotation of the cutter head 16 (the direction of the arrow in FIG. 2).

Matter excavated by the first cutters 26 is received through the corresponding notches 44 of the lower plate 36 into chambers 56. Each chamber 56 is a portion of the internal space of the first head 24 and communicated with a space under the lower plate 36 through the notches 44. Each chamber 56 communicates with the central space for receiving the second head 28 through an opening 58 formed in the inner side plate 40.

The first head 24 is provided in each chamber 56 with a guide 60 for forcibly moving the excavated matter taken into the chamber 56 through the opening 58 into the central space as the cutter head 16 rotates. Such a function may be performed by the base member or the like of each first cutter 26, or the first cutter 26 may be formed in the shape of a plow so that the first cutter 26 can forcibly move the excavated matter into the central space.

Figure 5:
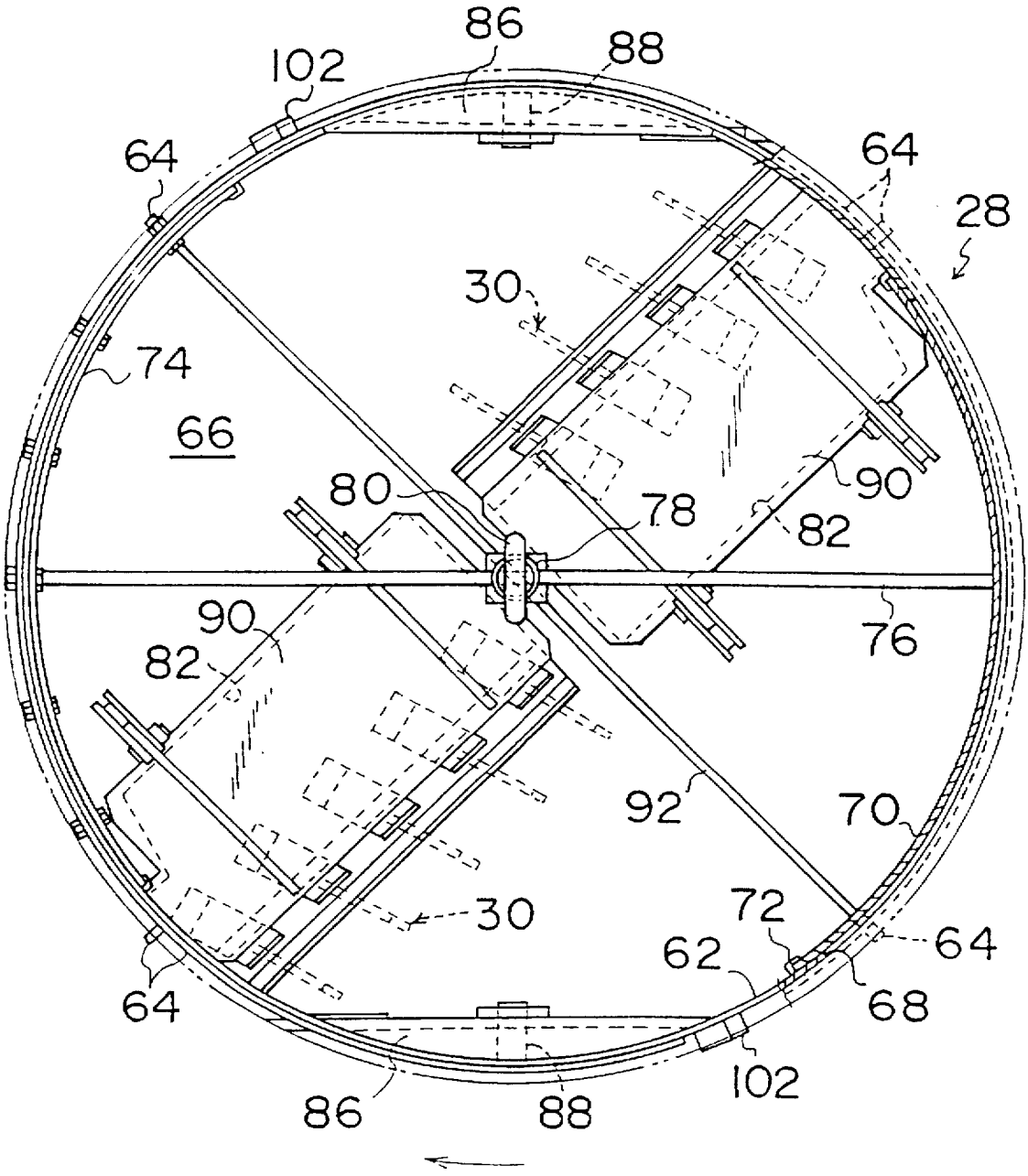
FIG. 5 is a partly cutaway plan view of a second head embodying the present invention.
Figure 6:
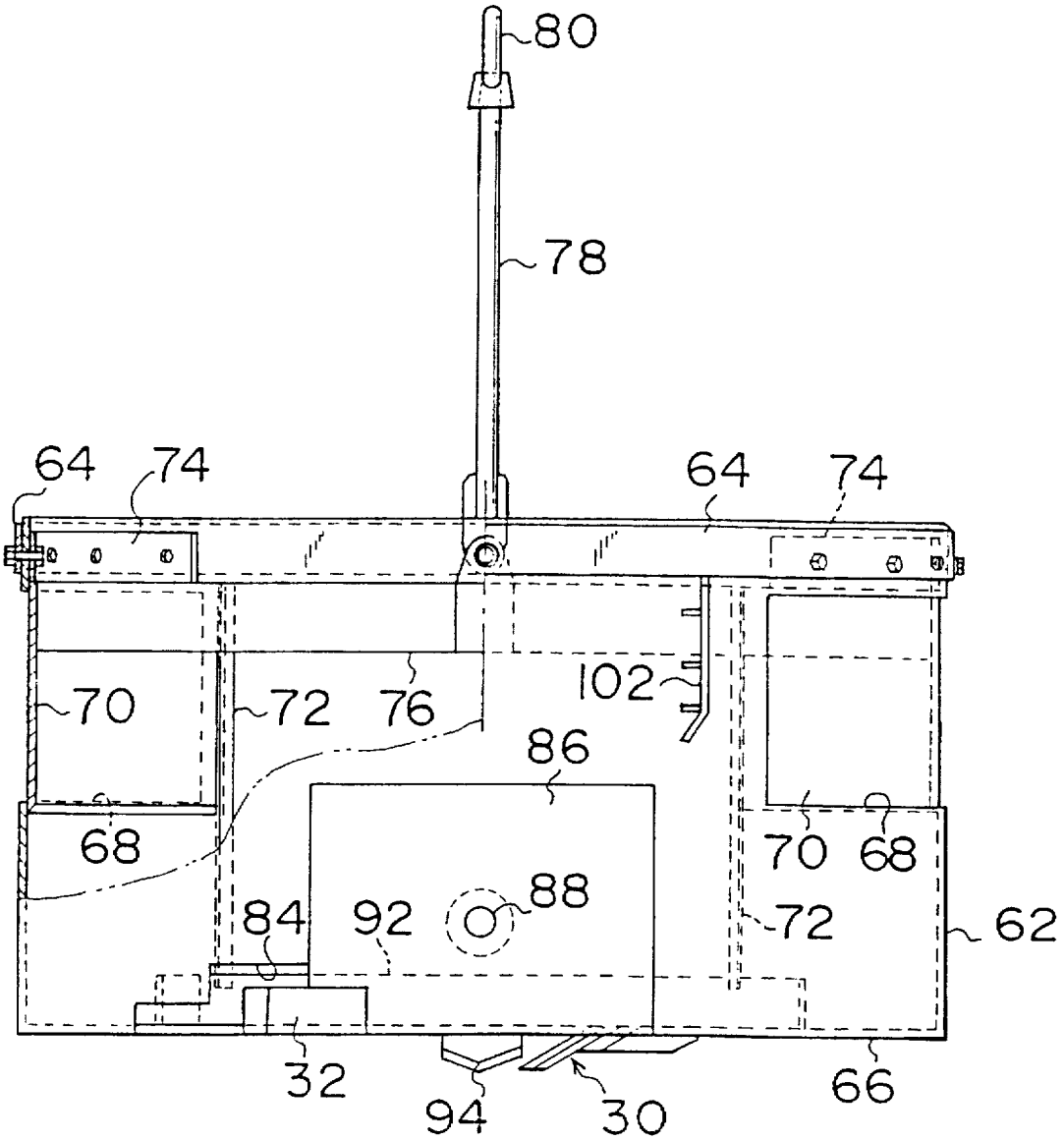
FIG. 6 is a partly cutaway front view of the second head of FIG. 5.
Figure 7:
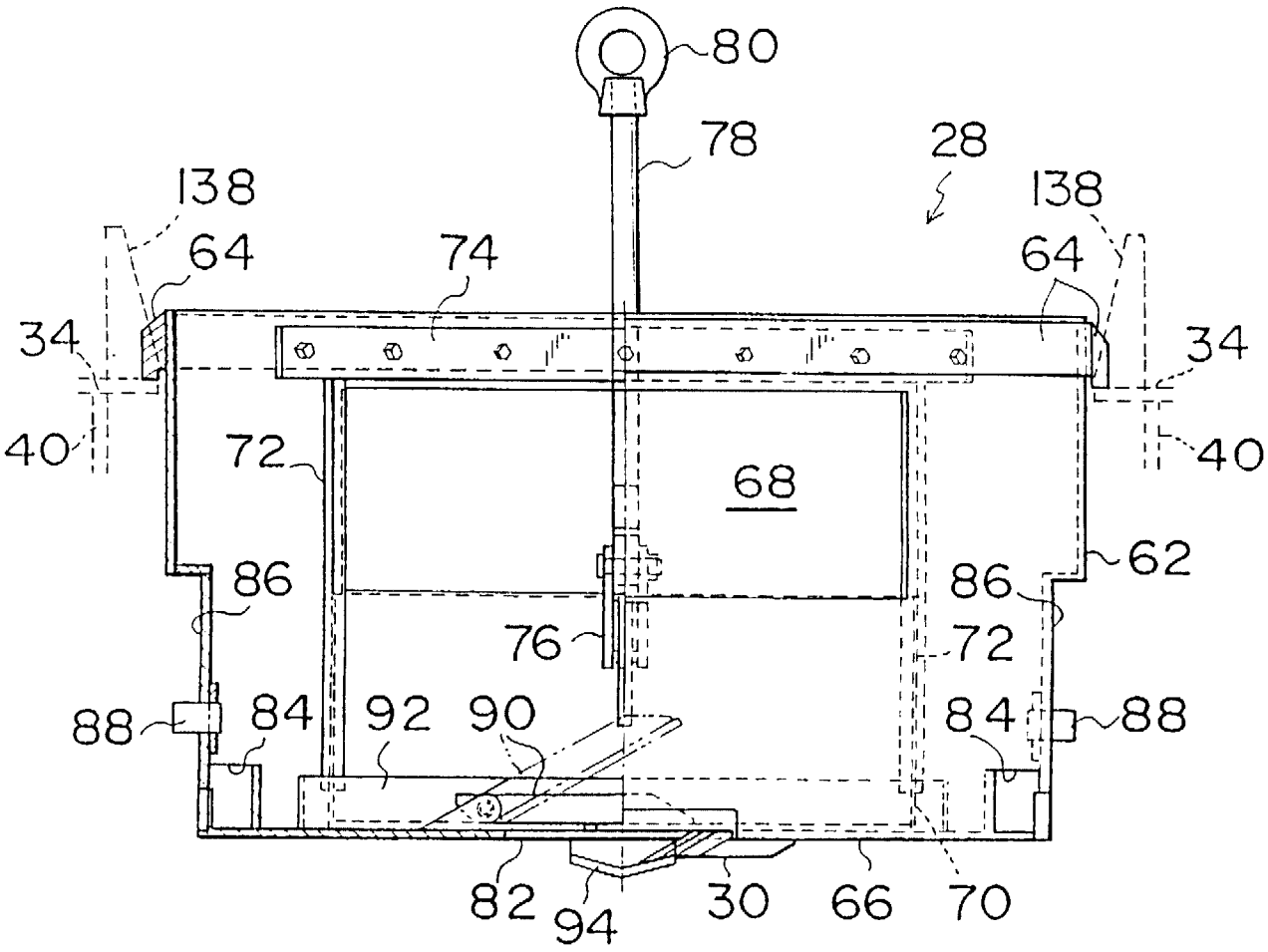
FIG. 7 is a partly cutaway right side view of the second head of FIG. 5.
Figure 8:
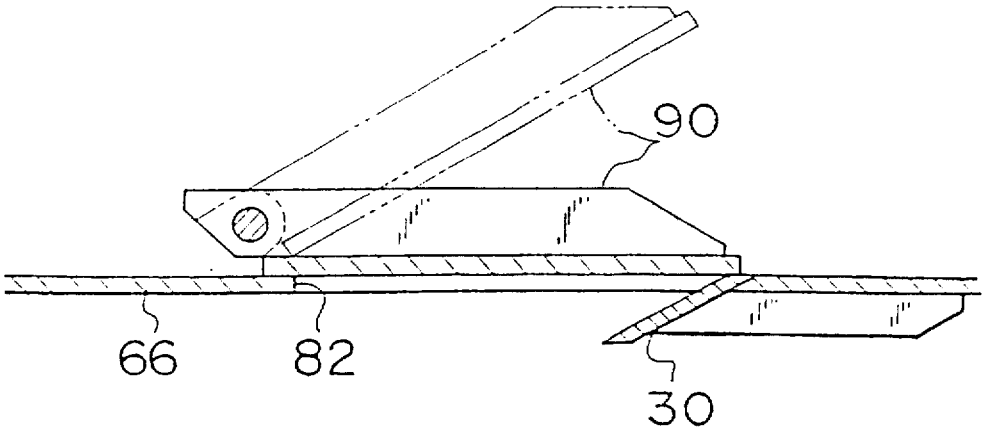
FIG. 8 is an enlarged sectional view of a potion near a second cutter.

As shown in FIGS. 5 to 7, the second head 28 comprises a cylindrical portion 62 removably received in the central space of the first head 24, stoppers 64 fixed to the outer circumference of the upper end of the cylindrical portion 62 with screws or the like, and a bottom plate 66 closing the lower end of the cylindrical portion 62.

The cylindrical portion 62 has a diameter slightly smaller than that of the central space of the first head 24, and a vertical length greater than that of the first head 24. The stoppers 64 has an outer diameter greater than that of the central space of the first head 24. Therefore, when the second head 28 is inserted into the central space of the first head 24, the stoppers 64 abuts on the member defining the central space of the first head 24 (the upper plate 34 in this embodiment) with the lower portion of the cylindrical portion 62 projected downward from the first head 24 and maintained, thereby determining the vertical position of the second head 28 relative to the first head 24.

The cylindrical portion 62 is provided in its upper portion with a plurality of openings 68 to receive the matter excavated by the first cutters 26. The openings 68 are arranged at equal angular intervals around the axis of the shield body 12. The openings 68, similarly to the notches 44 and opening 58 of the first head 24, are formed at two diametrically opposite positions on the cylindrical portion 62, respectively.

Shutters 70 for closing the openings 68 are supported to be able to vertically move along the inner circumference of the cylindrical portion 62. The motion of each shutter 70 is restricted in a vertical direction by a pair of guide rails 72 attached to the inner circumference of the cylindrical portion 62.

Stoppers 74 are attached to the upper end of the inner circumference of the cylindrical portion 62 to prevent the shutters 70 from getting out of the upper end of the cylindrical structure 62, whereby the bottom plate 66 prevents the shutters 70 from falling down from the cylindrical portion 62. When each shutter 70 is at a first position where the shutter 70 is in contact with the stoppers 74, the corresponding opening 68 is closed. When each shutter 70 is at a second position where the shutter 70 is in contact with the bottom plate 66, the corresponding opening 68 is opened.

Both the shutters 7( are interconnected at their upper ends by an elongate connecting member 76. An elongate suspending member 78 has its one end joined pivotally to the longitudinal middle part of the connecting member 76 so as to turn about a horizontal axis relative to the connecting member 76, and the other end provided with a suspension ring 80 to be hooked on the hoist hook of a hoisting machine.

The bottom plate 66 is provided with a plurality of openings or notches 82 to receive matter excavated by the second cutters 30 therethrough into the cylindrical portion 62. The notches 82 are in correspondence with the second cutters 30, respectively. In the embodiment shown in the drawings, the notches 82 are formed in a rectangular shape with their longer sides extended in parallel to a diameter of the second head 28 at two positions on the bottom plate 66.

Each second cutter 30 comprises a plurality of elongate base members detachably attached to the lower surface of the bottom plate 66 with bolts or the like, and cutting bits attached to the base members, respectively. Each base member of the second cutter 30 is attached to the rear edge of the corresponding notch 82 with respect to the direction of rotation of the cutter head 16 (in the direction of the arrows in FIGS. 2 and 5) so that the cutting edge of the cutting bit is directed forward with respect to the direction of rotation of the cutter head 16 and projects into part of the notch 82.

The cylindrical portion 62 is provided with a plurality of openings or notches 84 at the lower end thereof to receive matter excavated by the third cutters 32 therethrough into the cylindrical portion 62. The notches 84 are in correspondence with the third cutters 32. In the embodiment shown in the drawings, the notches 84 are formed at diametrically opposite positions, respectively, to extend in the circumferential direction of the cylindrical portion 62.

Each third cutter 32 has a cutting bit detachably attached to the lower end of the cylindrical portion 62 with a plurality of bolts or the like. The cutting bit of each third cutter 32 is disposed on the rear edge of the corresponding notch 84 with respect to the direction of rotation of the cutter head 16 with the cutting edge directed forward with respect to the direction of rotation of the cutter head 16 and projected into part of the notch 84.

The cylindrical portion 62 is provided with two steps 86 at diametrically opposite positions, respectively, on its inner circumference. Each notch 84 overlaps the step 86 partly. Each third cutter 32 is disposed on the step 86. Pins 88 are attached to the steps 86 by welding or the like at diametrically opposite positions, respectively, so as to project outside from the cylindrical portion 62.

The second head 28 is provided on the bottom plate 66 with lids 90 for opening and closing the notches 82 formed in the bottom plate 66. Each lid 90 is supported on the upper surface of the bottom plate 66 so as to be pivotable about a horizontal axis substantially parallel to a diameter of the cylindrical portion 62. Therefore, in the normal state, the lid 90 held at a closing position by its own weight to close the notches 82. When the cutter head 16 rotates, the lids 90 are pushed up by matters excavated by the second cutters 30, so that the notches 82 are opened.

The bottom plate 66 is provided with a diametrical rib 92 for reinforcement. The rib 92 is fixed to the upper surface of the bottom plate 66 by welding or the like. A fourth cutter 94 is attached to the central part of the lower surface of the bottom plate 66 so as to extend downward to excavate earth in the central part of the vertical hole.

Figure 9:
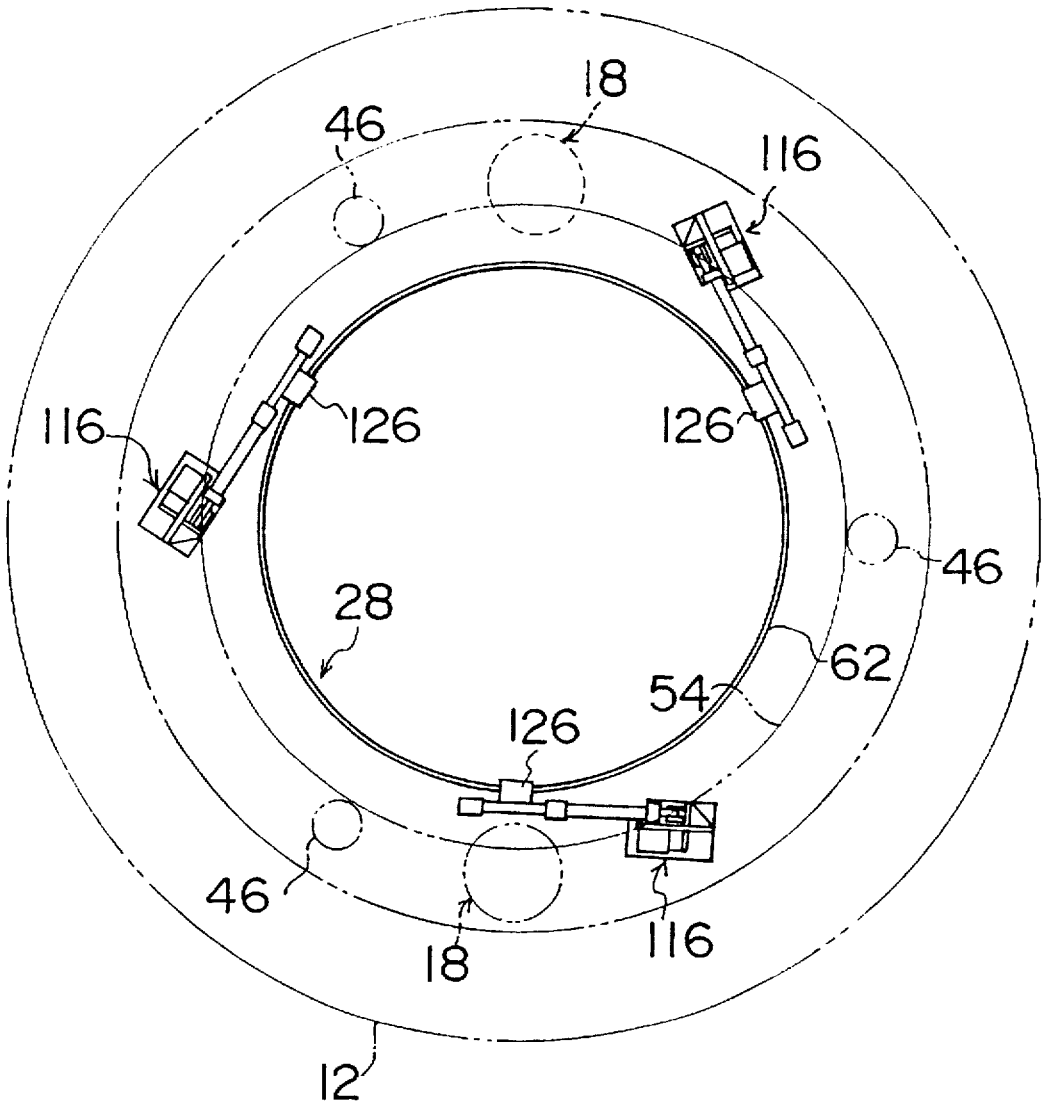
FIG. 9 is a plan view showing the disposition of a pushing mechanism.

As shown in FIGS. 1, 4 and 9, each driving mechanism 18 comprises a rotary source 96 with a reduction gear, and a driving pinion 98 mounted on the output shaft of the rotary source 96. The rotary sourcees 96 are installed on the shield body 12 so that the driving pinions 98 are arranged at equal angular intervals around the axis 14 of the shield body 12, and the driving pinions 98 are in engagement with the gear 52 of the support ring 50. When actuated, the rotary sources 96 drive the support ring 50 so as to rotate about the axis 14 to rotate the cutter head 16 about the axis 14.

The rotative force of each rotary source 96 is transmitted through the driving pinion 98 and the gear 52 to the first head 24 to which the support ring 50 is attached. When the first head 24 rotates, a plurality of lugs 100 attached to the inner circumference of the first head 24 come into engagement with a plurality of lugs 102 attached to the outer circumference of the second head 28, respectively, so that the second head 28 is rotated together with the first head 24.

As shown in FIG. 1, the excavating machine 10 further comprises a protective cylinder 104 set coaxially with the cylindrical body 12 on the inner periphery of the annular bed 22 coaxially attached to the bottom plate 20 of the shield body 12, and a flange-shaped top plate 106 attached to the upper end of the protective cylinder 104.

The annular bed 22, the protective cylinder 104 and the top plate 106 are separably joined together with bolts and nuts, not shown, or the like. The annular bed 22, the protective cylinder 104 and the top plate 106 may be permanently joined together by welding or the like.

The protective cylinder 104 may be formed of a plurality of posts, and a wire mesh, an iron plate or guard rails connected to the posts. When the protective cylinder 104 is thus formed, the top plate 106 is supported on the posts of the protective cylinder 104. The top plate 106 may be an iron plate provided with reinforcing ribs to enable the top plate 106 to receive matter fallen thereon from above and to serve as a temporary working floor in case of emergency or the like.

A space defined around the protective cylinder 104 by the annular bed 22, the protective cylinder 104 and the top plate 106 is available as a working space for an operator to work for assembling the segments into a covering or lining 108, for operating the excavating machine 10 and the like. The internal space of the protective cylinder 104 can be used as an excavated matter carrying-out space through which excavated matter is carried out.

The operator is able to climb down a ladder 110 from the ground to enter the working space and to climb up the ladder 110 to come out of the working space. Preferably, the protective cylinder 104 is provided with a gateway for the operator to move between the working space and the excavated matter carrying-out space. The excavated matter carrying-out space can be also used as the space for carrying materials or matter in and out matters from the working space.

Although not shown in the drawings, the protective cylinder 104 and the top plate 106 are divided into a plurality of segments arranged around the axis 14 of the shield cylinder 12, and the divided segments are separably joined to each other. However, the protective cylinder 104 and the top plate 106 need not be divided into a plurality of segments.

The respective inside diameters of the annular bed 22, the cover 54, the rings 48 and 50, the protective cylinder 104 and the top plate 106 are greater than the outer diameter of the largest part of the second head 28.

In the embodiment shown in the drawings, a thrusting mechanism for thrusting the cylindrical body 12 and the cutter head 16 downward comprises a plurality of thrusting jacks 114 using a reaction force from a lining 108. The thrusting jacks 114 are arranged on the inner surface of the shield body 12 at angular intervals around the axis 14. Each thrusting jack 114 is mounted on the cylindrical body 12 such that a cylinder thereof is seated on the upper surface of the bottom plate 20, while a piston rod thereof is brought into contact with the lower surface of the lining 108.

The thrusting jacks 114 can be also used for correcting the excavating direction. The excavating direction can be corrected by a method similar to that by an ordinary shield tunnel excavator. The thrust of each thrusting jack 114 is transmitted through the shield body 12, the rollers 46, and the rings 48 and 50 to the cutter head 16.

As shown in FIG. 9, the excavating machine 10 further comprises a plurality of pushing devices 116 for pushing the second head 28 downward relative to the first head 24. In the embodiment shown in FIG. 9, three pushing devices 116 are arranged at equal angular intervals around the axis 14.

Figure 10:
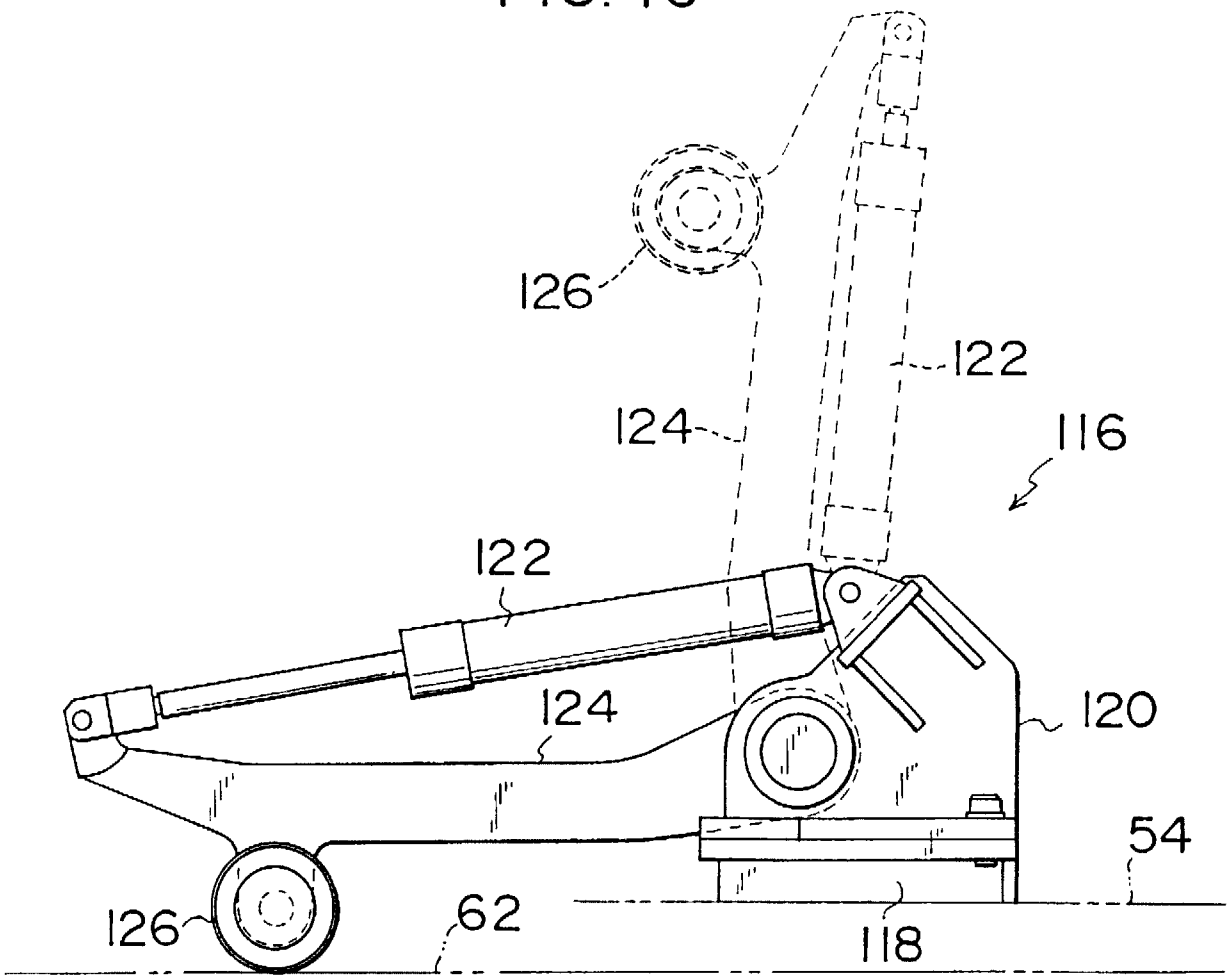
FIG. 10 is a front view of a pushing mechanism.
Figure 11:
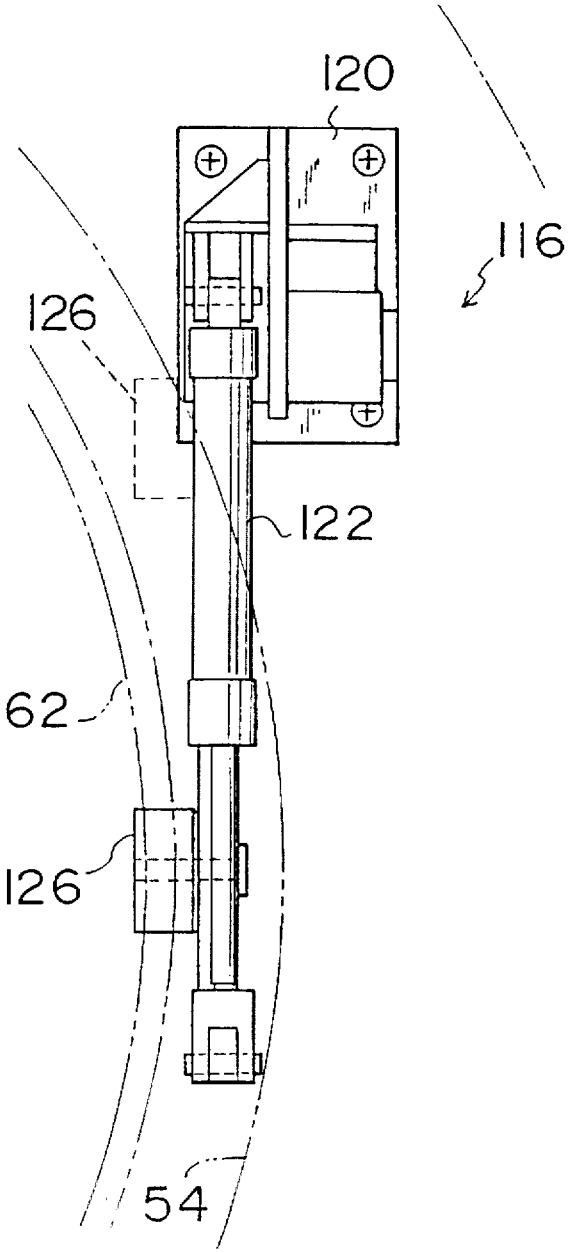
FIG. 11 is a plan view of the pushing mechanism of FIG. 10.

As shown in FIGS. 10 and 11, each pushing device 116 comprises a base 118 fixed to the cover 54, a bracket 120 detachably fastened to the base 118 with a plurality of bolts, a pushing jack 122 supported at one end thereof on the bracket 120 so as to be pivotally movable about a horizontal axis, an arm 124 pivotally supported at one end thereof on the bracket 120 so as to be pivotally movable about a horizontal axis, and supported at the the other end thereof on the pushing jacks 122 so as to be pivotally movable about a horizontal axis, and a roller 126 supported on the lower side of the arm 24 so as to be rotatable about a horizontal axis.

In the embodiment shown in the drawings, the pushing jacks 122 are hydraulically or pneumatically operated jacks. However, the pushing jacks 122 may be screw jacks. Each pushing jack 122 is connected with the bracket 120 on the side of the cylinder thereof and with the arm 124 on the side of the piston rod.

A pivot connecting the pushing jack 122 and the bracket 120, a pivot connecting the arm 124 and the bracket 120, a pivot connecting the pushing jack 122 and the arm 124, and a pivot connecting the roller 126 and the arm 124 are parallel to each other. The distance between the joint of the pushing jack 122 and the arm 124 and the joint of the pushing jack 122 with the bracket 120 is greater than the distance between a joint of the pushing jack 122 with the arm 124 and a joint of the bracket 120 with the arm 124.

Accordingly, as shown in FIG. 10, the arm 124 extends substantially horizontally when the pushing jack 122 is extended, and the pushing jack 122 and the arm 124 extend substantially vertically when the pushing jack 122 is contracted.

Each pushing device 116 is attached to the annular cover 54 so that the roller 126 may be pressed against the upper end of the cylindrical portion 62 of the second head 28 to depress the second head 28 when the pushing jack 122 is extended, so that the pushing jack 122, the arm 124 and the roller 126 may be retracted to positions where the pushing jack 122, the arm 124 and the roller 126 will not interfere with mounting and dismounting the second head 28 on and from the central space of the first head 24 when the pushing jack 122 is contracted.

When each pressing device 116 is disposed such that the pushing jack 122 and the arm 124 extend substantially parallel to a tangent to the locus of rotation of the second head 28 with the pushing jack 122 extended as shown in FIGS. 9 and 11, the pushing device 116 will not interfere with the second head 28.

Figure 12:
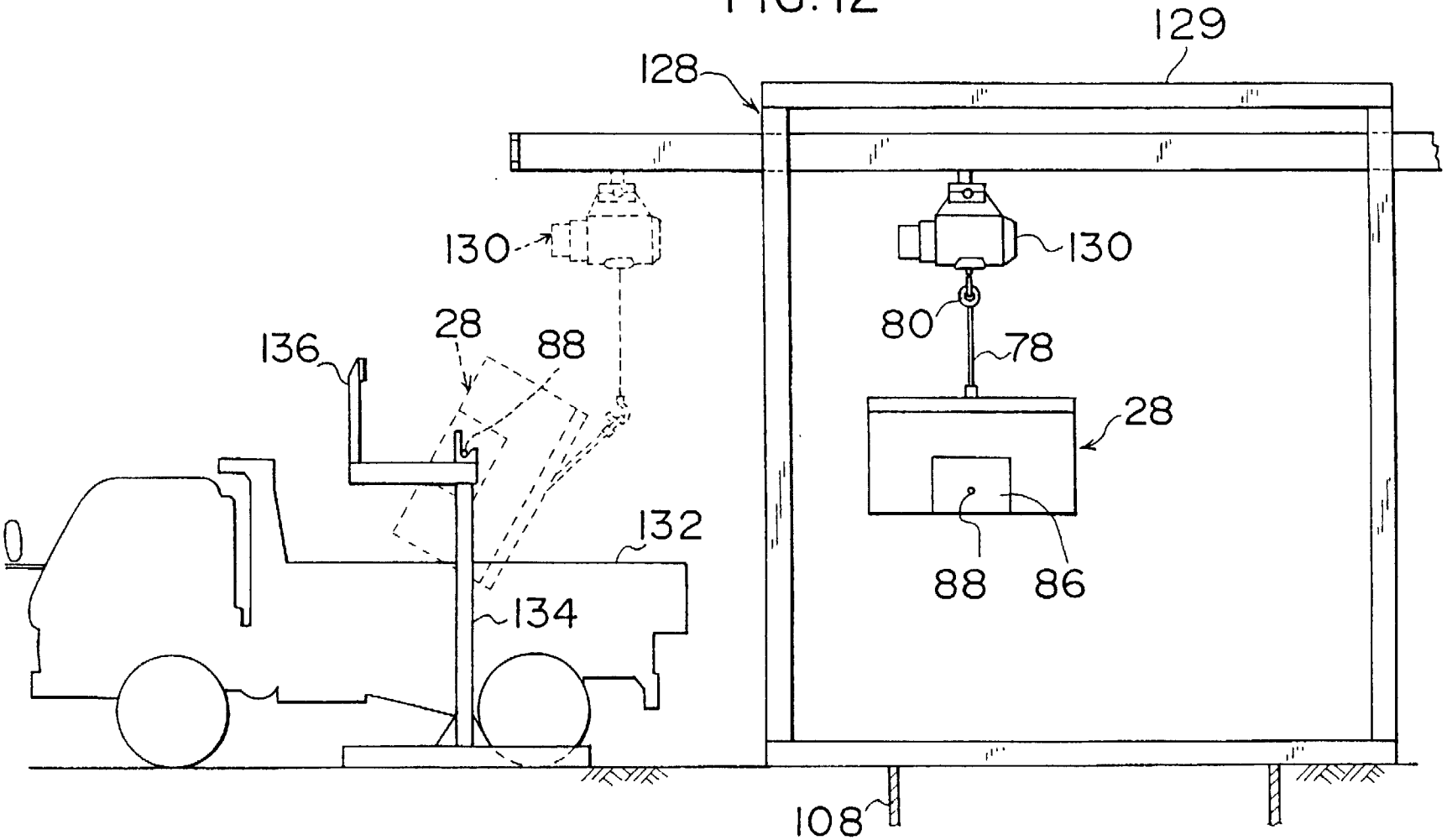
FIG. 12 is a front view of ground facilities.
Figure 13:
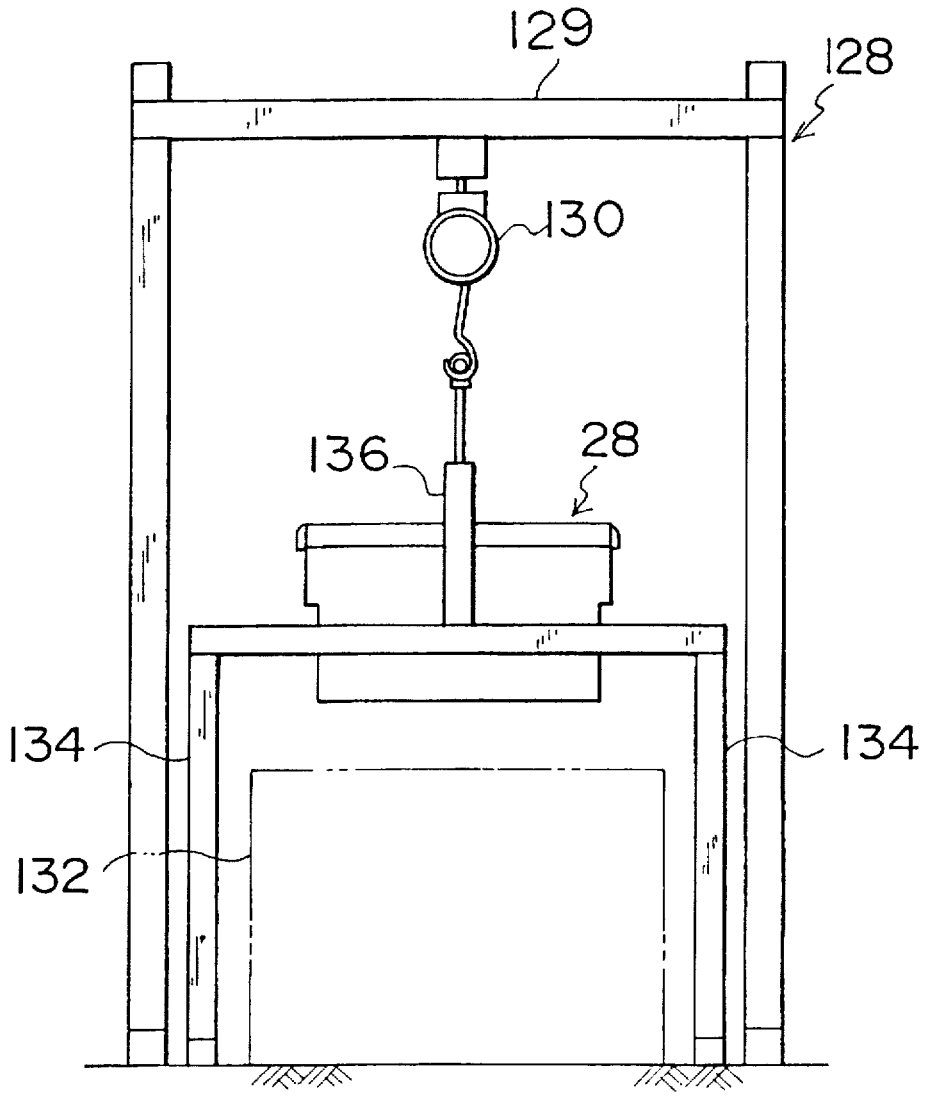
FIG. 13 is a right side view of the ground facilities of FIG. 12.

As shown in FIGS. 12 and 13, a gantry crane 128 is installed on the ground. The gantry crane 128 has a frame 129 installed on the ground, and a hoisting machine 130 supported on the frame 129 to move horizontally. The hoisting machine 130 is used for hoisting segments of the lining 108, the second head 28 and the like. For hoisting machine 130, for example, a power winch can be used.

When an empty second head 28 is mounted on the first head 24, the shutters 70 of the second head 28 are held at the lower position by their own weights and hence the openings 68 of the second head 28 are open. Since the second head 28 is depressed by the pushing devices 116, the stoppers 64 of the second head 28 are in contact with the first head 24 and the second head 28 is held in place with its openings 68 substantially coinciding with the openings 58 of the first head 24, respectively.

In this state, all the thrusting jacks 114 of the thrusting mechanism are extended synchronously while the rotary sources 96 of the driving mechanisms 18 are actuated. Accordingly, the driving pinions 98 is rotated, whereby the support ring 50 is rotated about the axis of the cylindrical body 12, and at the same time the first head 24 is rotated about the axis 14 of the cylindrical body 12.

In this case, if the openings 68 of the second head 28 are angularly displaced about the axis 14 relative to the opening 58 of the first head 24, only the first head 24 is rotated until the lugs 100 of the first head 24 come into engagement with the lugs 102 of the second head 28. Upon the engagement of the lugs 100 of the first head 24 with the lugs 102 of the second head 28, the openings 58 of the first head 24 coincide with the openings 68 of the second head 28, respectively, and the second head 28 is rotated together with the first head 24.

While the cutter head 16 is rotated, the first head 24 is pressed against earth under the first head 24 by the dead-weight of the excavating machine 10 and the thrusting jacks 114, and hence earth under the first head 24 is excavated by the first cutters 26.

Matter excavated by the first cutters 26 is inserted through the openings 58 of the first head 24 into the chamber 56 as the first head 24 rotates, and then the guides 60 forcibly moves the excavated matter toward the openings 68. Consequently, the excavated matter in the chamber 56 is pushed through the openings 58 of the first head 24 and the openings 68 of the second head 28 into the cylindrical portion 62. Thus, the matter excavated by the first cutters 26 can be automatically collected in the second head 28.

Similarly, the second head 28 is pressed against earth under the second head 28 by the thrusting jacks 114 and the pushing jacks 122 while the cutter head 16 is rotated and, consequently, earth under the second head 28 is excavated by the second cutters 30. Matter excavated by the second cutters 30 pushes up the lids 90 and goes through the notches 82 into the cylindrical portion 62 as the second head 28 is rotated.

While the second head 28 is rotated, the third cutters 32 excavate earth around the lower end of the second head 28. Matter excavated by the third cutters 32 goes through the notches 84 of the second head 28 into the cylindrical portion 62 as the second head 28 is rotated, so that frictional force that acts on the outer circumference of the second head 28 during excavation is reduced.

When the second head 28 is rotated, earth under the central part of the lower surface of the second head 28 is excavated by the fourth cutter 94. Matters excavated by the fourth cutter 94 goes together with the matter excavated by the second cutters 30 through the notches 84 of the second head 28 into the cylindrical portion 62 as the second head 28 is rotated, which can prevent the direction of excavation from changing.

Since the upward movement of the second head 28 relative to the first head 24 can be prevented when the second head 28 is pushed downward relative to the first head 24 by the pushing jacks 122 during the excavating operation, the second cutters 30 is able to function at a high excavation efficiency.

When a predetermined quantity of excavated matter has been collected in the cylindrical portion 62, the driving devices 18 are stopped to stop the excavating operation temporarily. Then, the pushing jacks 122 are contracted to retract the pushing devices 116 from the passage of the second head 28. Then, the ring 80 of the second head 28 is hooked on the hook of the hoisting machine 130 and the hoisting machine 130 hoists up the second head 28.

When the second head 28 is hoisted up, first the shutters 70 of the second head 28 are raised relative to the cylindrical structure 62 until the shutters 70 strike against the stoppers 74 to close the openings 68 of the second head 28, and then the whole of the second head 28 is hoisted up.

Since the openings 68 and the notches 82 are closed by the shutters 70 and the lids 90, respectively, while the second head 28 is being hoisted up, there is no fear that the excavated matter contained in the cylindrical portion 62 falls through the openings 68 and 82.

As shown in FIGS. 12 and 13, the excavated matter contained in the second head 28 hoisted up on the ground is transferred to a dump truck 132. For this purpose, a pair of posts 134 each having a Y-shaped head are set on the ground.

When transferring the excavated matter from the second head 28 to the dump truck 132, the pins 88 projecting outward from the lower part of the cylindrical portion 62 are seated on the Y-shaped heads of the posts 134, and in this state the second head 28 is lowered gradually. Since the weight of a portion of the second head 28 above the pins 88 is greater than that of a portion of the same below the pins 88, the second head 28 turns gradually on the pins 88 until the second head 28 is tipped over so that the bottom plate 66 becomes top, as shown in by the dotted line in FIG. 12. Stoppers 136 held on the posts 134 prevents the second head 28 from turning in such a manner as the upper part of the second head 28 faces the driver's cab of the dump truck 132.

As the second head 28 is tipped over on the pins 88, the excavated matter contained in the second head 28 are discharged onto the dump truck 132. After all the excavated matter has been dumped onto the dump truck 132, the second head 28 is lowered by the hoisting machine 130 into the vertical hole and is set in the central space of the first head 24. If the second head 28 is radially dislocated relative to the first head 24 when setting the second head 28 in the central space of the first head 24, the cylindrical portion 62 bumps or abuts on the upper plate 34 of the first head 24, and the second head 28 cannot be set into the central space of the first head 24. In order to prevent this, the second head 28 must be lowered with its axis in alignment with the axis of the first head 24. However, it is troublesome to carry out such a work by hand.

Therefore, the excavating machine 10 is provided with a plurality of guides 138, preferably three or more guides 138, on the first head 24. The guides 138 are disposed on the inner periphery of the upper side of the upper plate 34 at angular intervals around the axis 14 of the cylindrical body 12 and has an inner guide surface, namely an inclined plane such that the lower zone thereof is disposed centrally, namely, more inward than the upper zone thereof.

The cylindrical portion 62 is lowered with its lower end brought into contact with the inclined planes of the guides 138. Therefore, even if the second head 28 is displaced to some extent relative to the first head 24 when the second head 28 is mounted into the central space of the first head 24, the lower end of the cylindrical portion 62 is guided toward the center of rotation, namely, the side of the axis 14 by the guides 138, and so the second head 28 can be mounted into the central space of the first head 24 merely by lowering the second head 28.

When the second head 28 is mounted into the central space of the first head 24, since earth around the cylindrical portion 62 has been excavated excessively by the third cutter 32, the cylindrical portion 62 of the second cutter 28 can be easily mounted into the hole formed by the second and third cutters 30, 32 and easily, so that it is facilitated to mount and dismount the second head 28 into and from the central space of the first head 24 in order to discharge excavated matter.

After the second head 28 has been thus set in the central space of the first head 24, the pushing jacks 122 of the pushing devices 116 are re-extended to push the second head 28 forcibly against the first head 24 by the pushing devices 116. Therefore, the second head 28 can be correctly set in the central space of the first head 24 even if some of the excavated matter remaining in the chambers 56 of the first head 24 has fallen out of the chambers 56 into the central space of the first head 24 while the second head 28 is removed from the central space of the first head 24.

After the second head 28 has been correctly set in the central space of the first head 24, the excavating operation is resumed. When the cylindrical body 12 and the cutter head 16 are lowered by a predetermined distance, the excavating operation is interrupted, all the thrusting jacks 114 are contracted, and thereafter, assembling of segments into the lining 108 is carried out, and then the excavating operation is resumed.

The assembling of segments into the lining 108 may be carried out during the excavating operation without interrupting the excavating operation or may be carried out simultaneously with the work of discharging excavated matter.

When the advancing direction of the excavating machine 10 is to be corrected, the driving mechanisms 18 are driven for operation, while extending at least one of the thrusting jacks 114, whereby the advancing direction of the excavating machine 10 with respect to a vertical line is corrected gradually. The advancing direction of the excavating machine 10 with respect to a vertical line is corrected when at least one of the thrusting jacks 114 is extended by a predetermined length. After the advancing direction of the excavating machine 10 has been thus corrected, the driving mechanisms 18 are driven for operation while all the thrusting jacks 114 are extended synchronously at the same rate.

After the completion of excavation of a vertical hole of a predetermined depth, the cylindrical body 12, the cutter head 16, the annular bed 22, the protective cylinder 104 and the top plate 106 are disassembled into a plurality of sections, while the sections are carried out of the vertical hole to the ground to be used for excavating another vertical hole.

In this excavating machine 10, the length of the second head 28 is greater than that of the first head 24, and the lower part of the second head 28 projects downward from the lower end of the first head 24. Therefore, the loading capacity of the second head 28 can be increased without increasing the diameter of the cylindrical portion of the second head 28. However, the vertical length of the second head 28 need not be greater than that of the first head 24.

In this excavating machine 10, matter excavated by the first cutters 26 is received into a space formed over the lower plate 36, so that the resistance of excavation by the first cutters 26 is comparatively small, and the excavated matter can easily move from the chamber 56 over the lower plate 36 toward the second head 28. A head provided with a plurality of arms radially extending from the inner side plate 40 may be used as the first head, and the first cutters 26 may be mounted on one or more the radial arms.

A pipe pushing mechanism that pushes pipes inserted into the excavated hole to advance the cylindrical body 12 and the cutter head 16 may be used for thrusting the cylindrical body 12 instead of the thrusting jacks 114 that receives reaction force from the lining 108 for thrusting down the cylindrical body 12.

The plurality of rollers 46 each having an annular groove **46*a* of a V-shaped cross section may be held on the cutter head 16, and a support ring 50 provided with annular support ridge 50*a* fitting the annular groove 46*a* may be held on the cylindrical body 12. Support means, such as a plurality of bearings, other than the rollers 46 and the seat ring 50 may be used for rotatably supporting the cutter head 16 on the cylindrical body 12**.

A vertical hole excavating machine 200 shown in FIGS. 14 to 23, different from the excavating machine 10 shown in FIG. 10, uses a thrusting mechanism that receives reaction force from the ground to thrust down a cylindrical body 202. The shield body 202 has the shape of a short cylinder. The thrusting mechanism employed in the excavating machine 200 is provided with a cylindrical member 204 fitted outside the upper part of the cylindrical body 202.

Figure 22:
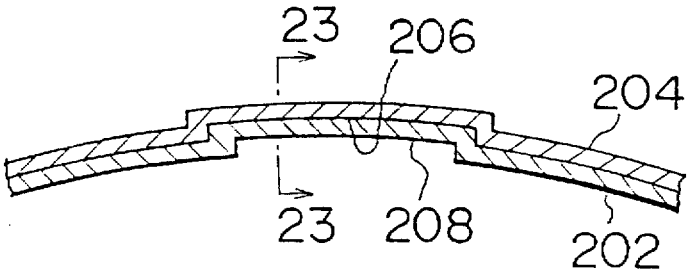
FIG. 22 is a sectional view of restraining means for restraining a a relative rotation of the cylindrical body and the cylindrical member in the excavating machine of FIG. 14.
Figure 23:
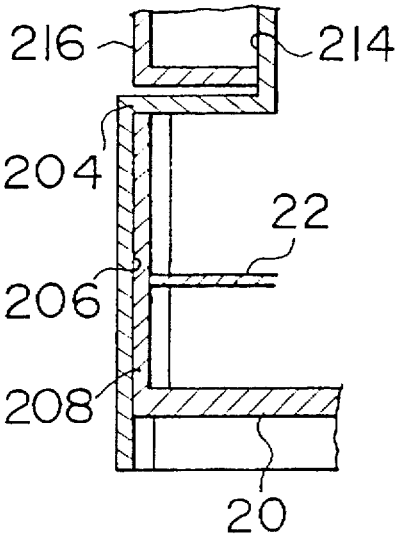
FIG. 23 is a sectional view taken on the line 23—23 in FIG. 22.

The cylindrical member 204 is axially movable along the axis 14 of the cylindrical body 202 relative to the cylindrical body 202 and is restrained from turning about the axis 14 relative to the cylindrical body 202 by at least one locking means. FIGS. 22 and 23 show an example of the locking means. The locking means comprises a vertical groove 206 formed in the lower part of the side wall of the cylindrical member 204, and a vertical protrusion 208 formed in the upper part of the cylindrical body 202 so as to extend in the vertical direction outward of the cylindrical body 202. The vertical protrusion 208 is fitted in the vertical groove 206.

Figure 17:
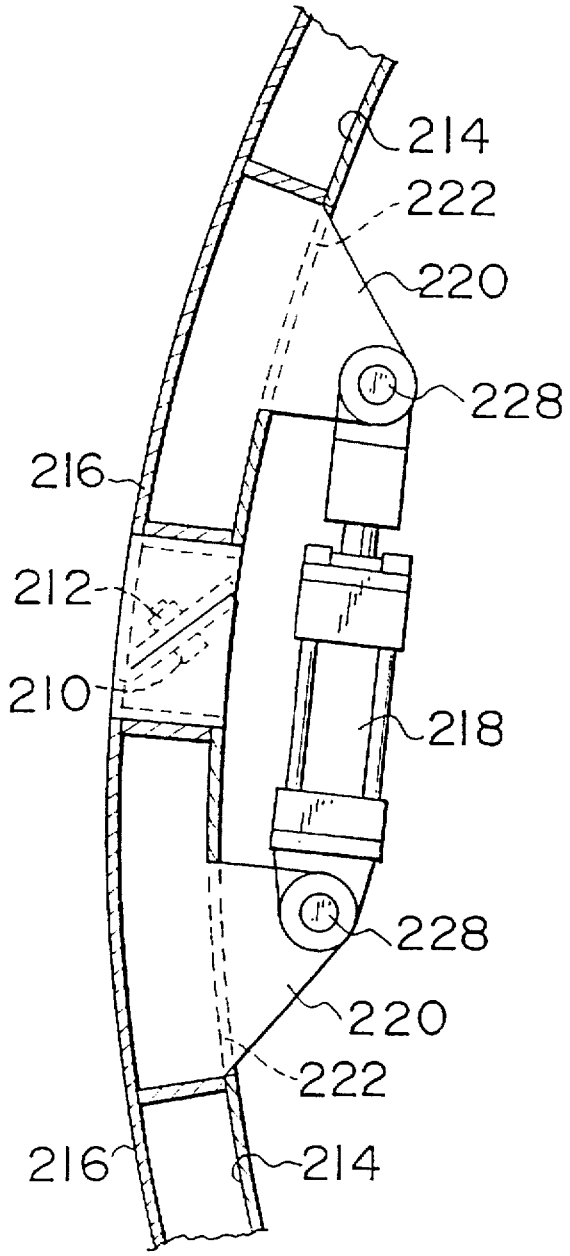
FIG. 17 is a cross-sectional view showing the relation between a pressing member and a first jack included in the excavating machine of FIG. 14, in which the first jack is contracted to retract the pressing member.
Figure 18:
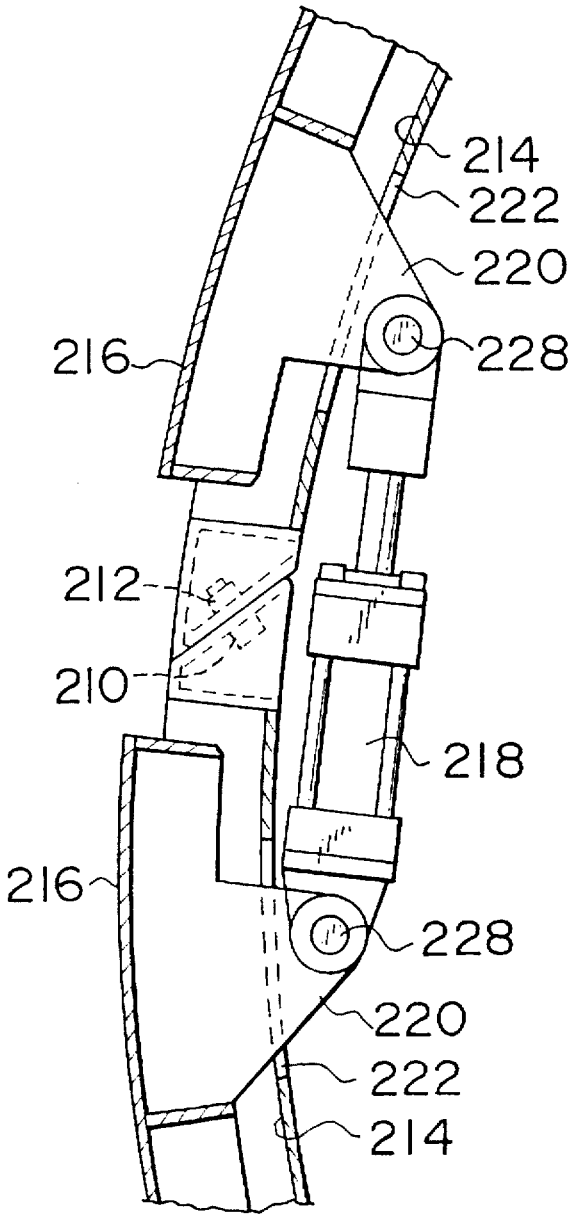
FIG. 18 is a cross-sectional view, similar to FIG. 17, in which the first jack is extended to project the pressing member.

The cylindrical member 204 is formed by assembling a plurality of circumferentially divided segments thereof. The adjacent circumferentially divided segments of the cylindrical member 204 are separably joined together with a plurality of bolts 210 and a plurality of nuts 212 as shown in FIGS. 17 and 18.

The cylindrical member 204 is provided in its outer circumference with a plurality of recesses 214 opening outward. The recesses 214 are extended circumferentially on a level slightly above the height of the vertical groove 206. The circumferentially adjacent recesses 214 are separated by the joints of the adjacent segments of the cylindrical member 204. Reaction pushing members 216 are disposed in the recesses 214, respectively. Each reaction pushing member 216 is curved so as to conform to the recess 214.

Figure 19:
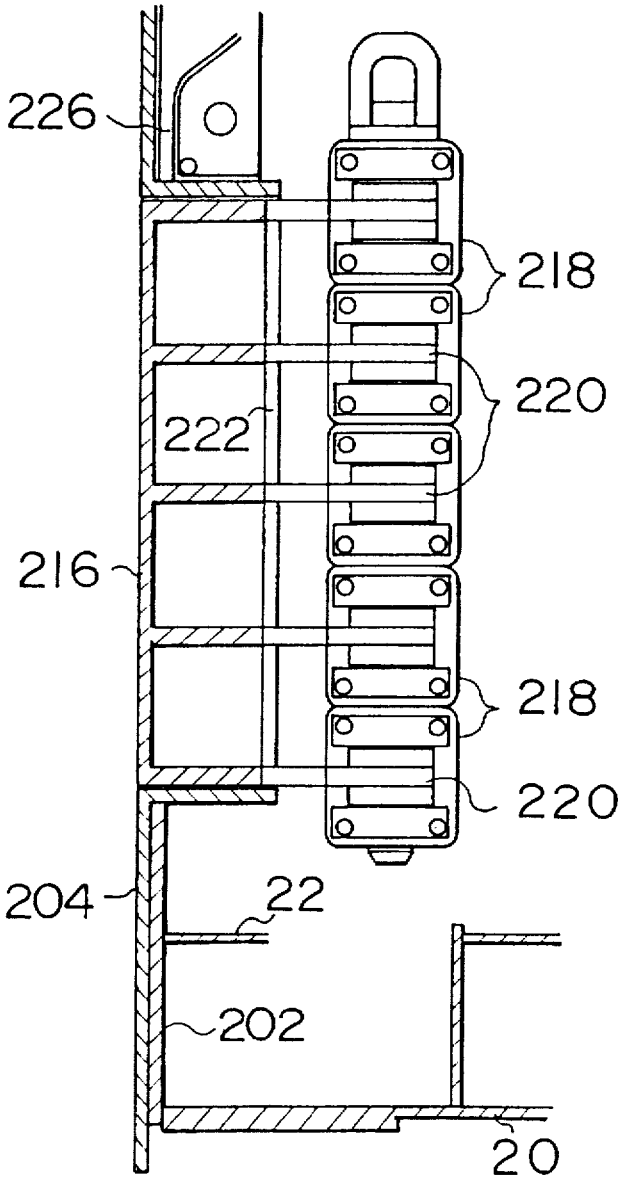
FIG. 19 is a longitudinal sectional view showing the relation between the pressing member and the first jack of the excavating machine of FIG. 14, in which the first jack is contracted to retract the pressing member.
Figure 20:
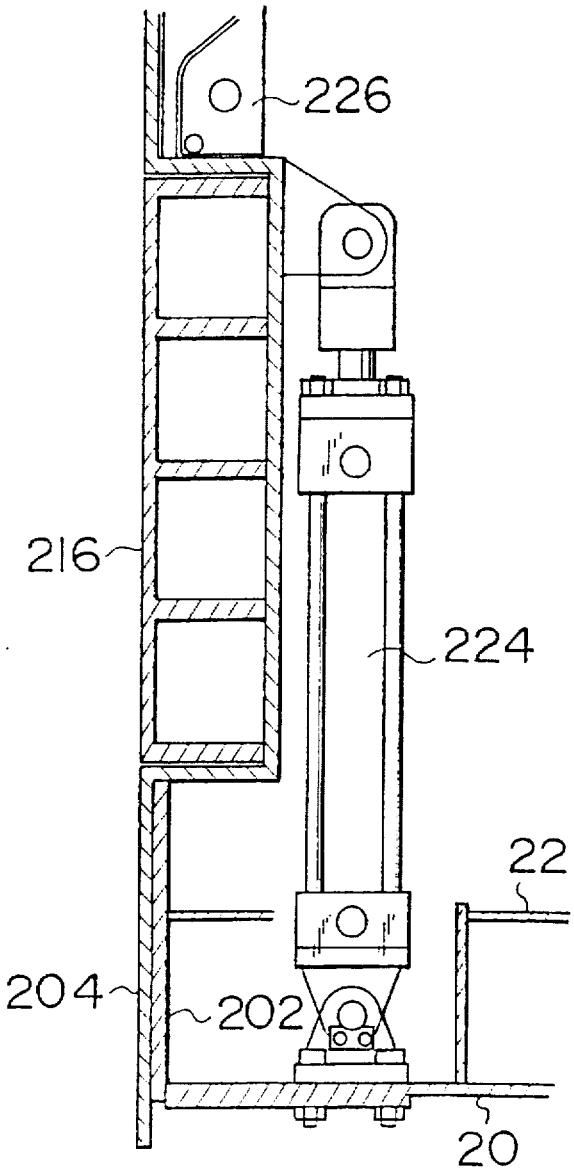
FIG. 20 is a longitudinal sectional view showing the relation between the pressing member and a second jack in the excavating machine of FIG. 14, in which the pressing member is retracted and the second jack is contracted.
Figure 21:
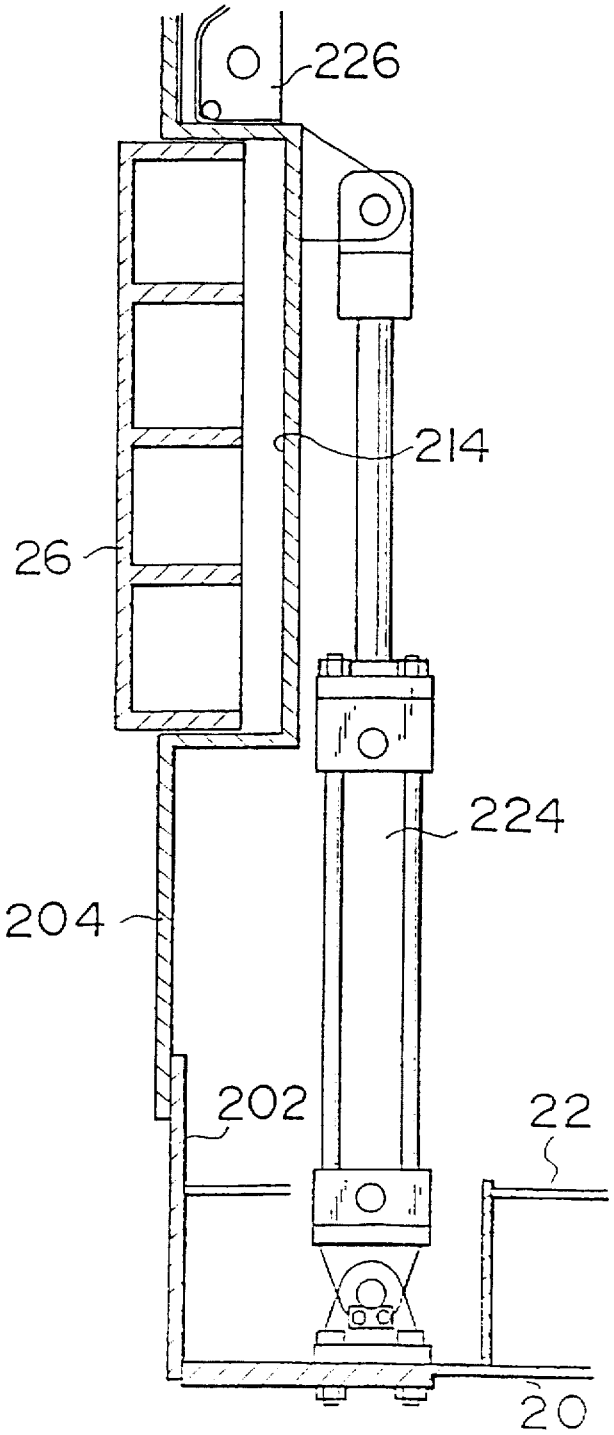
FIG. 21 is a longitudinal sectional view showing the relation between the pressing member and the second jack in the excavating machine of FIG. 14, in which the pressing member is projected and the second jack is extended.

The circumferentially adjacent pushing members 216 can be moved toward and away from each other by a plurality of reaction jacks, i.e., first jacks 218, vertically arranged at intervals. Each first jack 218 is a fluid-pressure jack, such as a hydraulic jack, and has a cylinder connected to one end of one of the pushing members 216 by a connecting plate 220, and a piston rod connected to one end of the other pushing member 216 as shown in FIGS. 19 to 21.

Each connecting plate 220 extends inward from one circumferential end of the corresponding pushing member 216 over a notch 222 (FIGS. 17 to 19) formed in the cylindrical member 204. Each connecting plate 220 is formed integrally with the pushing member 216 or is welded to the pushing member 216. The plurality of first jacks 218 for displacing the same pushing member 216 are supported pivotally on the connecting plates 220 by a single common shaft 228 so that the first jacks 218 extend and contract synchronously.

The cylindrical body 202 and the cylindrical member 204 are interconnected by a plurality of thrusting jacks, i.e., second jacks 224 arranged at intervals around the axis 14. Each second jack 224 has a cylinder connected to a bottom plate 20 and a piston rod connected to the cylindrical member 204.

When the first jacks 218 of the excavating machine 200 are contracted, the adjacent pushing members 216 are drawn toward each other and are received in the corresponding recesses 214, respectively, as shown in FIGS. 15 to 17 and 20.

Figure 14:
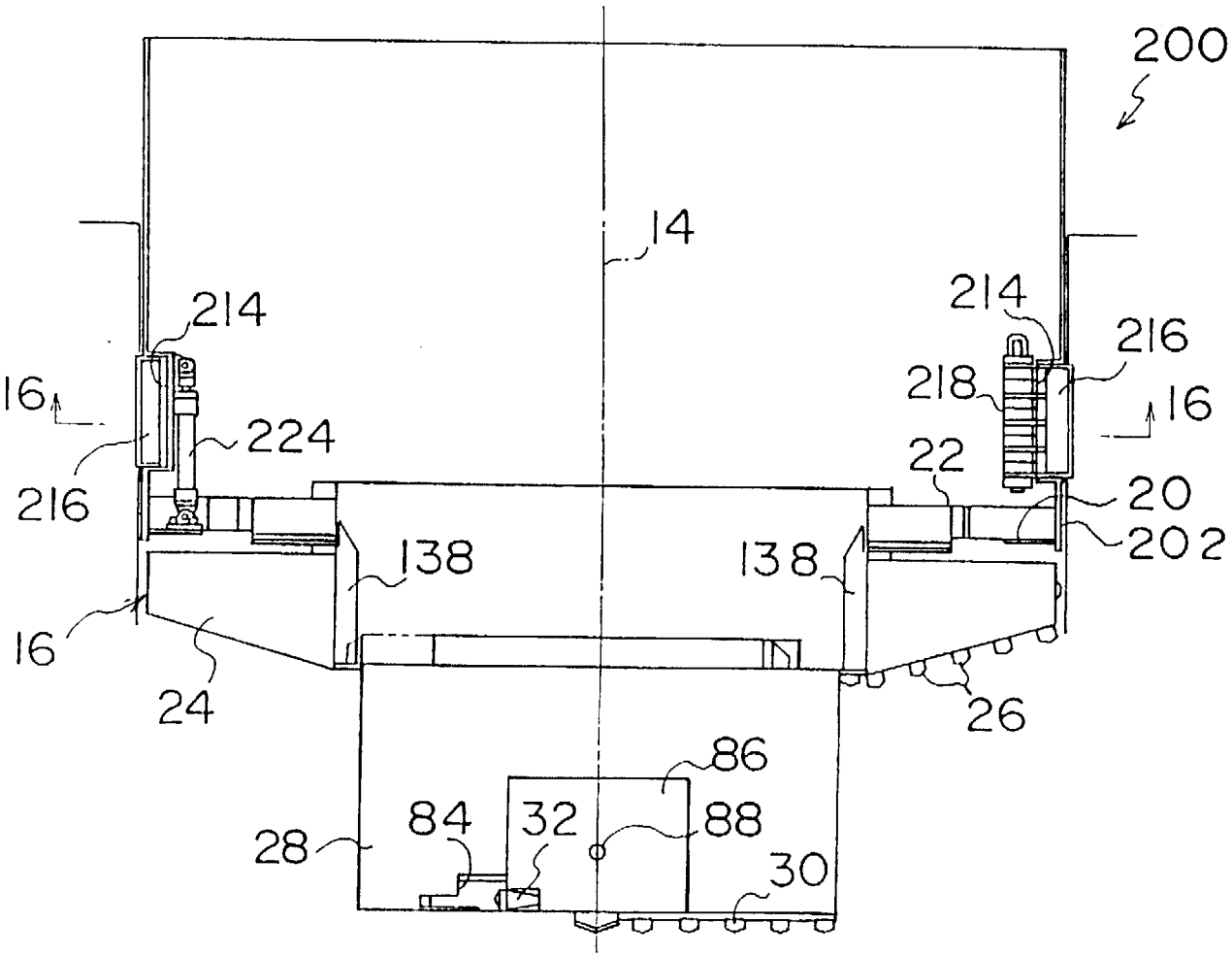
FIG. 14 is a longitudinal sectional view of an excavating machine in another embodiment according to the present invention, in which a pushing member is projected.
Figure 15:
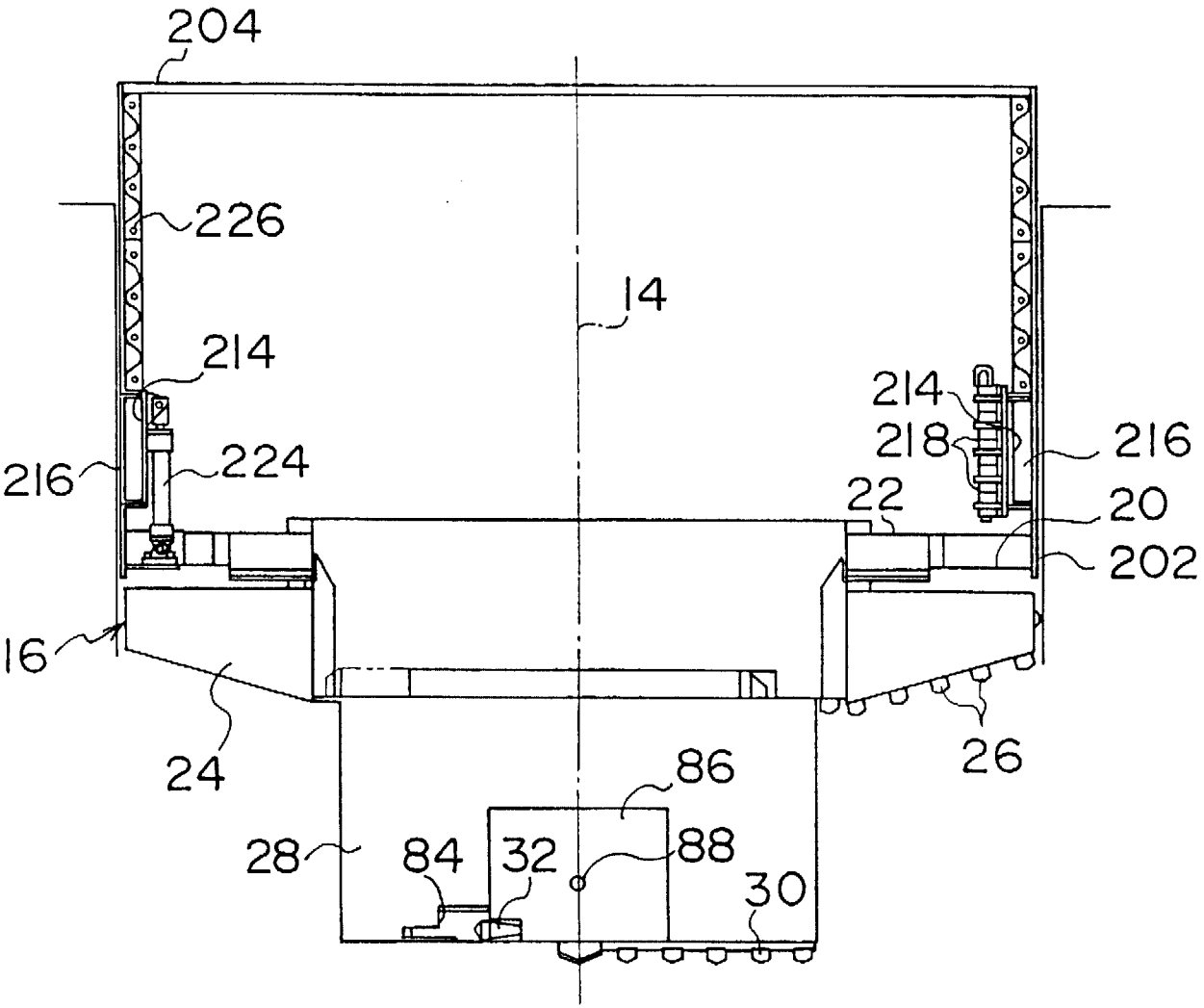
FIG. 15 is a longitudinal sectional view of the excavating machine of FIG. 14, in which the pushing member is retracted.
Figure 16:
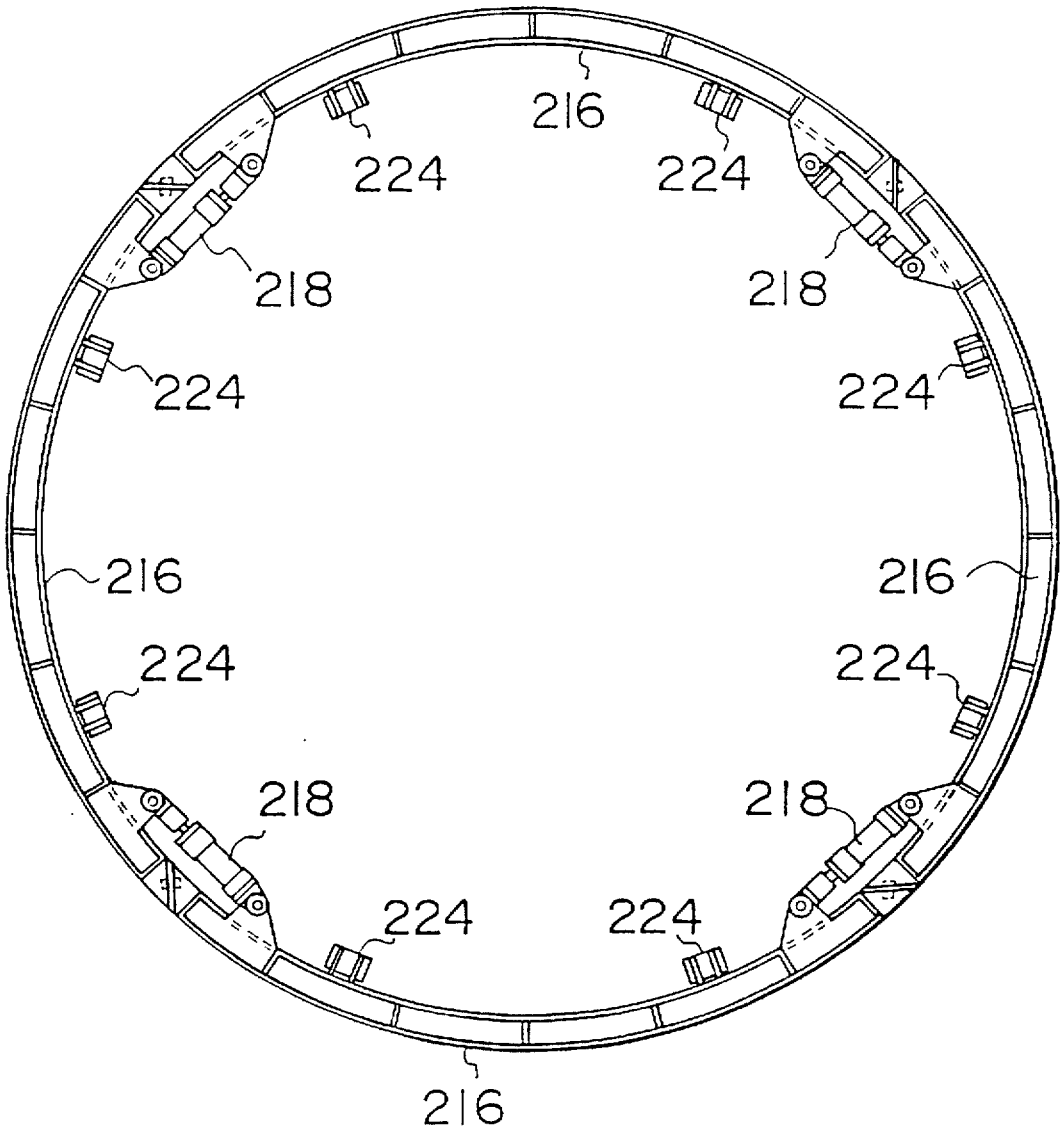
FIG. 16 is a sectional view taken on the line 16—16 in FIG. 14.

When the first jacks 218 are extended the adjacent pushing members 216 are moved away from each other and radially outward of the cylindrical member 204 as shown in FIGS. 14, 18 and 21, so that the pushing members 216 are partly protruded from the recesses 214 and pressed against the ground surrounding the cylindrical member 204.

Then, the cutter head 16 of the excavating machine 200 is rotated with the first jacks 218 extended and the second jacks 224 extended gradually to excavate the ground. The thrusting reaction force due to the extension of the second jacks 224 is transmitted through the cylindrical member 204, the first jacks 218 and the pushing members 216 to the ground surrounding the cylindrical member 204. A rotative reaction force due to the rotation of the cutter head 16 is transmitted through the vertical protrusions 208, the vertical groove 206, the cylindrical member 204, the first jacks 218 and the pushing members 216 to the ground surrounding the cylindrical member 204.

When the second jacks 224 are fully extended as shown in FIG. 21, the first jacks 218 are contracted to separate the pushing members 216 from the ground surrounding the cylindrical member 204, and in this state the second jacks 224 are contracted to pull down the cylindrical member 204.

Thereafter, the lining members 226 are installed successively on the cylindrical member 204 while a process of excavating the ground by gradually extending the second jacks 224 and rotating the cutter head 16 with the first jacks 218 extended and a process of pulling down the cylindrical member 204 by contracting each of the second jacks 224 in the state where each of the first jacks 218 is contracted are repeated predetermined times.

Since the adjacent pushing members 216 of this excavating machine 200 are displaced by the plurality of parallel first jacks 218 vertically arranged at intervals, the first jacks 218 may be of a small capacity as compared with a single jack employed in an arrangement which displaces a pair of the adjacent pushing members by the single jack, so that the internal space of the excavating machine 200 can be effectively utilized. However, a pair of the adjacent pushing members may be displaced by a single jack. The pushing members 216 may be displaced radially of the cylindrical member 204 by a displacing means capable of directly moving the pushing members 216 radially of the cylindrical member 204 instead of the first jacks 218 for moving the adjacent pushing members 216 toward and away from each other.

What is claimed is:

1. A vertical hole excavating machine comprising: a cylindrical body disposed with its axis in a vertical position; a cutter head disposed to be rotatable about the axis of the cylindrical body at the lower end of the cylindrical body; and a driving mechanism for rotating the cutter head; said cutter head including a first head supported to be rotatable about the axis of the cylindrical body at the lower end of the cylindrical body and having a central space vertically extending therethrough; at least one first cutter disposed on the first head to excavate earth under the first head; a second head disposed in the central space and coaxially with the first head so as to be removably inserted from above, the second head having a cylindrical portion to receive matter excavated by the first cutter therein and a bottom closing the lower end of the cylindrical portion; and at least one second cutter disposed on the second head to excavate earth under the second head; wherein the second head is further provided with a notch formed at the bottom to receive matter excavated by the second cutter into the cylindrical portion, and a lid disposed on the upper side of the bottom to be angularly rotatable about the axis extending horizontally to open and close the notch on the upper side of the bottom; wherein the lid which in its normal state closes the notch by its own weight is pushed up by the excavated matter when the cutter head is rotated thereby opening the notch.

2. A vertical hole excavating machine according to claim 1, wherein the first head or the first cutter is provided with a guide for guiding matter excavated by the first cutter toward the central space as the cutter head rotates.

3. A vertical hole excavating machine according to claim 1, wherein the first head is provided with a plurality of guide portions disposed on the upper surface of a member forming the upper end of the central space, each guide portion having an inclined guide surface such that the lower portion of the inclined guide surface is closer to the side of the central space than the upper portion.

4. A vertical hole excavating machine according to claim 1, wherein the second head is further provided with a stopper on the outer periphery of the upper end of the cylindrical portion, the stopper coming into contact with the upper surface of the member defining the upper end of the central space.

5. A vertical hole excavating machine according to claim 1, wherein the vertical length of the second head is greater than that of the first head, and wherein at least a part of the second head projects downward from the first head when the second head is disposed in the first head.

6. A vertical hole excavating machine comprising: a cylindrical body disposed with its axis in a vertical position; a cutter head disposed to be rotatable about the axis of the cylindrical body at the lower end of the cylindrical body; and a driving mechanism for rotating the cutter head; said cutter head including a first head supported to be rotatable about the axis of the cylindrical body at the lower end of the cylindrical body and having a central space vertically extending therethrough; at least one first cutter disposed on the first head to excavate earth under the first head; a second head disposed in the central space and coaxially with the first head so as to be removably inserted from above, the second head having a cylindrical portion to receive matter excavated by the first cutter therein and a bottom closing the lower end of the cylindrical portion; and at least one second cutter disposed on the second head to excavate earth under the second head, wherein the second head is provided in the bottom with a notch to receive matter excavated by the second cutter into the cylindrical portion, wherein the vertical length of the second head is greater than that of the first head, and wherein at least a part of the second head projects downward from the first head when the second head is disposed in the first head; and wherein the cylindrical structure of the second head is provided with an opening formed in its cylindrical portion so as to receive matter excavated by the first cutter into the cylindrical portion, and a shutter vertically movable along the inner circumference of the cylindrical portion to open and close the opening formed therein.

7. A vertical hole excavating machine according to claim 6, wherein the first head has a plate-like portion forming a lower surface extending around the central space, wherein the first cutter is disposed to excavate earth under the plate-like portion, and wherein the plate-like portion is provided with a notch to receive matter excavated by the first cutter into the upper surface, the notch communicating with an upper space on the plate-like portion.

8. A vertical hole excavating machine according to claim 5, wherein the cutter head is further provided with a third cutter on the outer surface of the lower part of the cylindrical portion to excavate earth around the second head, and wherein the second head is provided with a notch in the lower part of the cylindrical portion to receive matter excavated by the third cutter into the cylindrical portion.

9. A vertical hole excavating machine according to claim 1, wherein the second head is provided outside the lower part of the cylindrical portion with a pair of pins extending in the opposite directions to each other.

10. A vertical hole excavating machine according to claim 1, wherein a plurality of the first cutters are arranged at angular intervals around the axis of the cylindrical body, and wherein the second head is provided with a plurality of openings formed at angular intervals around the axis of the cylindrical body to receive matter excavated by the first cutters into the cylindrical portion, a plurality of shutters arranged to be movable vertically on the inner side surface of the cylindrical portion, each shutter opening and closing the opening, and a connecting member for connecting the upper end of both the shutters with each other.

11. A vertical hole excavating machine comprising: a cylindrical body disposed with its axis in a vertical position; a cutter head disposed to be rotatable about the axis of the cylindrical body at the lower end of the cylindrical body; and a driving mechanism for rotating the cutter head; said cutter head including a first head supported to be rotatable about the axis of the cylindrical body at the lower end of the cylindrical body and having a central space vertically extending therethrough; at least one first cutter disposed on the first head to excavate earth under the first head; a second head disposed in the central space and coaxially with the first head so as to be removably inserted from above, the second head having a cylindrical portion to receive matter excavated by the first cutter therein and a bottom closing the lower end of the cylindrical portion; and at least one second cutter disposed on the second head to excavate earth under the second head; wherein the second head is provided in the bottom with a notch to receive matter excavated by the second cutter into the cylindrical portion; and a pushing mechanism for pushing the second head downward relative to the first head, the pushing mechanism being retractable to positions where the pushing member does not interfere with the mounting and dismounting the second head on and from the central space.

12. A vertical hole excavating machine comprising: a cylindrical body disposed with its axis in a vertical position; a cutter head disposed to be rotatable about the axis of the cylindrical body at the lower end of the cylindrical body; and a driving mechanism for rotating the cutter head; said cutter head including a first head supported to be rotatable about the axis of the cylindrical body at the lower end of the cylindrical body and having a central space vertically extending therethrough; at least one first cutter disposed on the first head to excavate earth under the first head; a second head disposed in the central space and coaxially with the first head so as to be removably inserted from above, the second head having a cylindrical portion to receive matter excavated by the first cutter therein and a bottom closing the lower end of the cylindrical portion; and at least one second cutter disposed on the second head to excavate earth under the second head; wherein the second head is provided in the bottom with a notch to receive matter excavated by the second cutter into the cylindrical portion; and a thrusting mechanism for thrusting down the cylindrical body, said thrusting mechanism including a plurality of jacks arranged at angular intervals around the axis of the cylindrical body so as to push the cylindrical body by reaction force from a lining disposed on the upper portion of the cylindrical body.

13. A vertical hole excavating machine according to claim 1, further comprising a thrusting mechanism for thrusting down the cylindrical body, said thrusting mechanism including a cylindrical member fitted on the upper portion of the cylindrical body so as to be axially movable relative to the cylindrical body, a plurality of arcuate pushing members successively arranged in the circumferential direction on the outer circumference of the cylindrical member, a plurality of first jacks for radially displacing the pushing members, and the plurality of second jacks arranged at angular intervals around the axis of the cylindrical body to push the cylindrical body by reaction force from the cylindrical member.

14. A vertical hole excavating machine according to claim 13, wherein each of the first jacks moves the pushing members adjacent to each other in the circumferential direction toward and away from each other.

15. A vertical hole excavating machine according to claim 13, wherein the cylindrical body and the cylindrical member are fitted on each other so as not to rotate relative to each other about the axis.

* * * * *

UNITED STATES PATENT AND TRADEMARK OFFICE

CERTIFICATE OF CORRECTION

PATENT NO. : 5,797,202

DATED : August 25, 1998

INVENTOR(S) : Toshio Akesaka

It is certified that error appears in the above-identified patent and that said Letters Patent is hereby corrected as shown below:

Column 2 Line 53 "farmed therein." should read --formed therein--.

Column 3 Line 62 "react ion" should read --reaction--.

Column 3 Line 67 "m ember" should read --member--.

Column 5 Line 61 "Die upper plate" should read --The upper plate--.

Column 7 Line 51 "Both the shutters 7( are" should read --Both the shutters 70 are--.

Signed and Sealed this

Second Day of February, 1999

*Attest:*

*Attesting Officer*

*Acting Commissioner of Patents and Trademarks*